US010149067B2

(12) United States Patent
Kim et al.

(10) Patent No.: US 10,149,067 B2
(45) Date of Patent: Dec. 4, 2018

(54) METHOD FOR CONTROLLING FUNCTION BASED ON BATTERY INFORMATION AND ELECTRONIC DEVICE THEREFOR

(71) Applicant: Samsung Electronics Co., Ltd., Gyeonggi-do (KR)

(72) Inventors: Sang-Wook Kim, Seoul (KR); Young-Joon Choi, Gyeonggi-do (KR); Jong-Hee Han, Seoul (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 47 days.

(21) Appl. No.: 14/966,405

(22) Filed: Dec. 11, 2015

(65) Prior Publication Data

US 2016/0183009 A1 Jun. 23, 2016

(30) Foreign Application Priority Data

Dec. 19, 2014 (KR) ..... 10-2014-0184554

(51) Int. Cl.
*H04R 25/00* (2006.01)

(52) U.S. Cl.
CPC ..... *H04R 25/30* (2013.01); *H04R 25/558* (2013.01); *H04R 25/552* (2013.01); *H04R 25/554* (2013.01)

(58) Field of Classification Search
CPC .. H04R 25/552; H04R 25/554; H04R 25/558; H04R 25/55; H04R 25/305; H04R 25/30; H04R 2225/31; H04R 2460/03
USPC ..... 381/315, 314, 312
See application file for complete search history.

(56) References Cited

U.S. PATENT DOCUMENTS

| | | | | |
|---|---|---|---|---|
| 5,608,803 | A | 3/1997 | Magotra et al. | |
| 6,035,050 | A * | 3/2000 | Weinfurtner | H04R 25/507 381/313 |
| 6,353,413 | B1 * | 3/2002 | White | G01S 5/0045 342/453 |
| 8,005,232 | B2 * | 8/2011 | Roeck | H04R 25/70 381/312 |
| 9,319,806 | B2 * | 4/2016 | Ku | H04R 25/552 |
| 2004/0190738 | A1 * | 9/2004 | Meier | H04R 25/505 381/312 |
| 2005/0208893 | A1 | 9/2005 | Yueh | |
| 2008/0013763 | A1 | 1/2008 | Lotter et al. | |
| 2009/0074216 | A1 * | 3/2009 | Bradford | H04R 25/554 381/315 |
| 2009/0129615 | A1 | 5/2009 | Kasanmascheff | |
| 2009/0298431 | A1 | 12/2009 | Rasmussen | |
| 2011/0033073 | A1 * | 2/2011 | Inoshita | H04R 25/552 381/323 |
| 2011/0038500 | A1 | 2/2011 | Heerlein et al. | |
| 2011/0064252 | A1 | 3/2011 | Ma et al. | |

(Continued)

OTHER PUBLICATIONS

ReSound LiNX2—The Latest in Smart Hearing, pp. 1-15, http://www.resound.com/hearing-aids/resound-linx2.

*Primary Examiner* — Phylesha Dabney
(74) *Attorney, Agent, or Firm* — Cha & Reiter, LLC.

(57) ABSTRACT

A method and apparatus for operating an electronic device may include: acquiring the battery status information of two or more element devices, and determining whether the battery status information satisfies a reference condition. A function of at least one device among the two or more element devices is controlled based on the information such as the battery status information.

15 Claims, 12 Drawing Sheets

(56) References Cited

U.S. PATENT DOCUMENTS

| | | | | |
|---|---|---|---|---|
| 2011/0249835 | A1 | 10/2011 | Lunner et al. | |
| 2011/0261982 | A1* | 10/2011 | Isozaki | H04R 25/305 381/315 |
| 2011/0299710 | A1* | 12/2011 | Ochi | H04R 25/552 381/315 |
| 2012/0177234 | A1 | 7/2012 | Rank et al. | |
| 2013/0045684 | A1 | 2/2013 | Linde et al. | |
| 2013/0070946 | A1* | 3/2013 | Kroman | H04R 25/558 381/315 |
| 2014/0307901 | A1* | 10/2014 | Ku | H04R 25/552 381/315 |
| 2015/0201284 | A1* | 7/2015 | Park | H04R 25/30 381/323 |
| 2016/0183009 | A1* | 6/2016 | Kim | H04R 25/30 381/315 |

* cited by examiner

METHOD FOR CONTROLLING FUNCTION BASED ON BATTERY INFORMATION AND ELECTRONIC DEVICE THEREFOR

CLAIM OF PRIORITY

This application claims the benefit of priority under 35 U.S.C. § 119(a) from Korean Application Serial No. 10-2014-0184554, which was filed in the Korean Intellectual Property Office on Dec. 19, 2014, the entire content of which is hereby incorporated by reference.

BACKGROUND

1. Field of the Disclosure

Various embodiments of the present disclosure relate to a method for controlling a function based on the battery information of an electronic device and an electronic therefor.

2. Description of the Related Art

Electronic devices such as hearing aids receive sound and may convert and output audio from around a user so as to be clearly heard by the user. In addition, the electronic device may convert (for example, amplify) and output the audio through a microphone or speaker. People who use such devices often have a difficult time using mobile phones, particularly for audio calls. For example, in order for a user who is wearing an electronic device such as a hearing aid to make a phone call, the user needs to make a call while holding the phone (for example, a smart phone) in hand, thereby causing an inconvenience of using an auxiliary device, such as hands-free. In addition, for an electronic device, such as binaural hearing aids, the battery of one side of the hearing aid that faces the direction of transmitting and receiving data to and from another electronic device connected by network communication is consumed faster than the battery of the other side, so that an inconvenience in use such as battery replacement can be caused.

SUMMARY

An electronic device may include a microphone and an encoder, generate specified audio data based on the input audio, and transmit the generated audio data to at least one other electronic device connected by the network communication.

When the electronic device is configured by two or more element devices such as binaural hearing aids, each of the element devices can be controlled based on the device status information of the electronic device.

According to various embodiments of the disclosure, a method for operating an electronic device may include: acquiring battery status information of two or more element devices; determining whether the battery status information satisfies a reference condition; and controlling a function of at least one device from among the two or more element devices.

According to various embodiments of the disclosure, an electronic device may include a battery; and a processor including circuitry configured for that acquires battery status information of two or more element devices, determines whether the battery status information satisfies a reference condition; and controls a function of at least one device from among the two or more element devices.

According to various embodiments of the disclosure, an electronic device may include a computer-readable recording medium in which a program for executing operations is recorded, the operations comprising: acquiring battery status information of two or more element devices; determining whether the battery status information satisfies a reference condition; and controlling a function of at least one device from among the two or more element devices.

According to various embodiments of the disclosure, an electronic device, such as a hearing aid, may provide to a user wearing the electronic device various interfaces related to the audio, by efficiently using an encoder and/or a battery in processing the input audio.

BRIEF DESCRIPTION OF THE DRAWINGS

The above and other aspects, features, and advantages of the present disclosure will become more apparent to a person of ordinary skill in the art from the following detailed description, when taken in conjunction with the accompanying drawings, in which.

DETAILED DESCRIPTION

Figure 1:
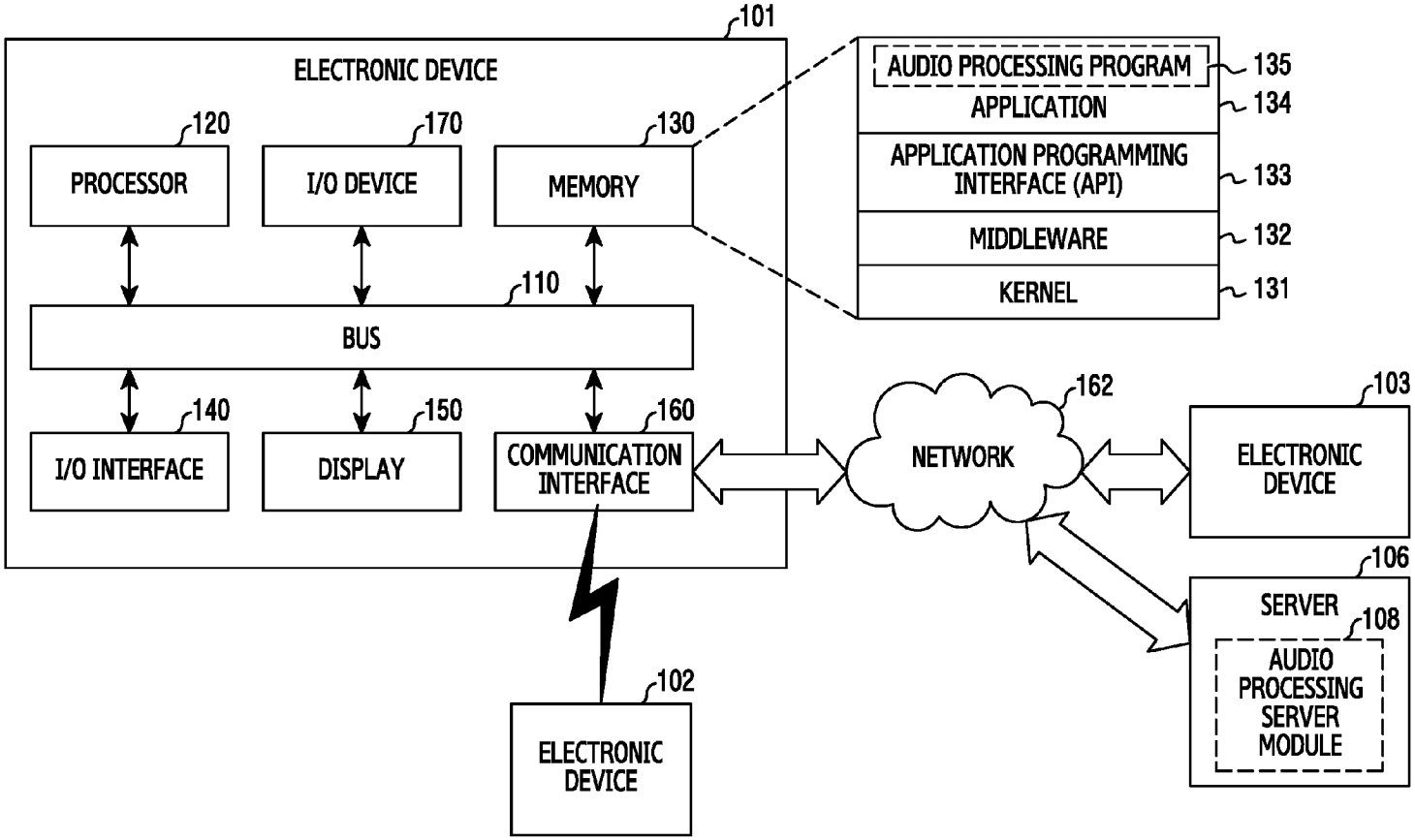
FIG. 1 is a block diagram illustrating a network environment including electronic devices according to various embodiments of the disclosure.

Hereinafter, various embodiments of the present disclosure will be described in connection with the accompanying drawings.

The present disclosure may have various embodiments, and an artisan understand and appreciates that modifications and changes may be made therein. It should also be understood that for written description purposes, elements of one embodiment may be combined with elements from another embodiment (or embodiments) unless otherwise specified to the contrary.

Therefore, the present disclosure will be described in detail for illustrative purposes with reference to particular embodiments shown in the accompanying drawings. However, an artisan should understand that the present disclosure is not limited to the particular embodiments shown and described herein, but includes all modifications, equivalents, and/or alternatives within the spirit and scope of the present disclosure. In the description of the drawings, similar reference numerals may be used to designate similar elements.

Various embodiments of the present disclosure will refer to expressions such as "include", "may include" and other conjugates, that refer to the existence of a corresponding disclosed function, operation, or constituent element, and do not limit one or more additional functions, operations, or constituent elements. Further, various embodiments of the present disclosure will refer to the terms "include", "have", and their conjugates are intended merely to denote a certain feature, numeral, step, operation, element, component, or a combination thereof, and should not be construed to initially exclude the existence of or a possibility of addition of one or more other features, numerals, steps, operations, elements, components, or combinations thereof.

Various embodiments of the present disclosure will refer to the expression "or", which includes any or all combinations of words enumerated together. For example, the expression "A or B" or "at least A and/or B" may include A, may include B, or may include both A and B.

In the present disclosure, expressions including ordinal numbers, such as "first" and "second" etc., may modify various elements. However, such elements are not limited by the above expressions. For example, the above expressions do not limit the sequence and/or importance of the elements. The above expressions are used merely for the purpose of distinguishing an element from the other elements. For example, a first user device and a second user device indicate different user devices although both of them are user devices. For example, without departing from the scope of the present disclosure, a first component element may be named a second component element. Similarly, the second component element also may be named the first component element.

When an element is referred to as being "coupled" or "connected" to any other element, it should be understood that not only the element may be coupled or connected directly to the other element, but also a third element may be interposed therebetween. Contrarily, when an element is referred to as being "directly coupled" or "directly connected" to any other element, it should be understood that no element is interposed therebetween.

Various embodiments of the present disclosure refer to terms that merely describe a certain embodiment and do not limit the present disclosure. As used herein, singular forms may include plural forms as well unless the context explicitly indicates otherwise. Furthermore, all terms used herein, including technical and scientific terms, may have the same meaning as commonly understood by those of skill in the art to which the present disclosure pertains. Such terms may be defined in a generally used dictionary as understood by an artisan to have contextual meanings in the relevant field of art, and are not to be interpreted to have ideal or excessively formal meanings unless clearly defined in various embodiments of the present disclosure.

An electronic device according to various embodiments of the present disclosure may be a device that includes structure to perform communication functions. For example, the electronic device may include at least one of a smart phone, a tablet Personal Computer (PC), a mobile phone, a video phone, an e-book reader, a desktop PC, a laptop PC, a netbook computer, a PDA, a Portable Multimedia Player (PMP), an MP3 player, a mobile medical device, a camera, a wearable device (for example, a Head-Mounted-Device (HMD) such as electronic glasses, electronic clothes, an electronic bracelet, an electronic necklace, an electronic appcessory, an electronic tattoo, and a smart watch. A hearing aid device may include a hearing-aid function supported system (for example, a mobile device, TV, CE/IT devices, etc.), plug-in accessories (or, a module for hearing aids) that have a sound and a broadcast relay function in the hearing aid, and a chip that has a hearing-aid function.

The electronic device according to various embodiments of the present disclosure may be an electronic device including a plurality of element devices. A plurality of element devices may include battery information. The plurality of element devices may include, for example, an output device (e.g., a speaker) of a wireless multi-channel audio device, and each output device may include a component such as a communication unit (a data input/output transmission unit) or a processing unit. The components of each output device can be controlled by the battery information.

An electronic device according to various embodiments of the present disclosure may include a plurality of element devices, and each element device may include at least one from among audio processor, an output unit, a compression unit, a wireless transceiver, and a controller. The plurality of element devices may include battery information, and the plurality of element devices can be controlled through the battery information.

Further, those skilled in the art should readily understand that the electronic device according to various embodiments of the present disclosure is not limited to the aforementioned devices.

Hereinafter, an electronic device according to various embodiments of the present disclosure will be described with reference to the accompanying drawings. The term "user" as used in various embodiments of the present disclosure may indicate a person who accesses an electronic device or a device (e.g., artificial intelligence electronic device) that uses an electronic device.

FIG. 1 is a block diagram illustrating a network environment including electronic devices according to various embodiments.

Referring now to FIG. 1, an electronic device 101 may include at least one of a bus 110, a processor 120, a memory 130, an input/output interface 140, a display 150, and a communication interface 160.

The bus 110 may be a circuit that interconnects the aforementioned elements and transmits communication signals (e.g., control messages) between the aforementioned elements.

The processor 120, which includes hardware circuitry configured for operation, may receive, for example, commands from the above-mentioned other elements (e.g., the memory 130, the input/output interface 140, the display 150, and the communication interface 160) via the bus 110, interpret the received commands, and perform calculations or data processing according to the interpreted commands.

At least one processor 120 may be included in the electronic device 101 to perform a specified function of the electronic device 101. According to an embodiment, the processor 120 may include one or more application processors (APs) and one or more micro controller units (MCUs).

According to another embodiment, the processor 210 may include one or more micro controller units executing certain applications, or may be functionally connected to one or more micro controllers. The MCU's constitute hardware, having circuitry configured for operation. In FIG. 1, the APs and the MCUs may be included in one IC package, or may be separately configured to be included in different IC packages, respectively. According to an embodiment, the MCUs may be included in an IC package of the APs to be configured as one IC package together with the APs. Although the processor 120 is illustrated as including the APs or the MCUs as elements thereof, the illustration is provided for explanatory purposes, and the processor 120 may also perform the operations of the APs and/or the MCUs.

Figure 2:
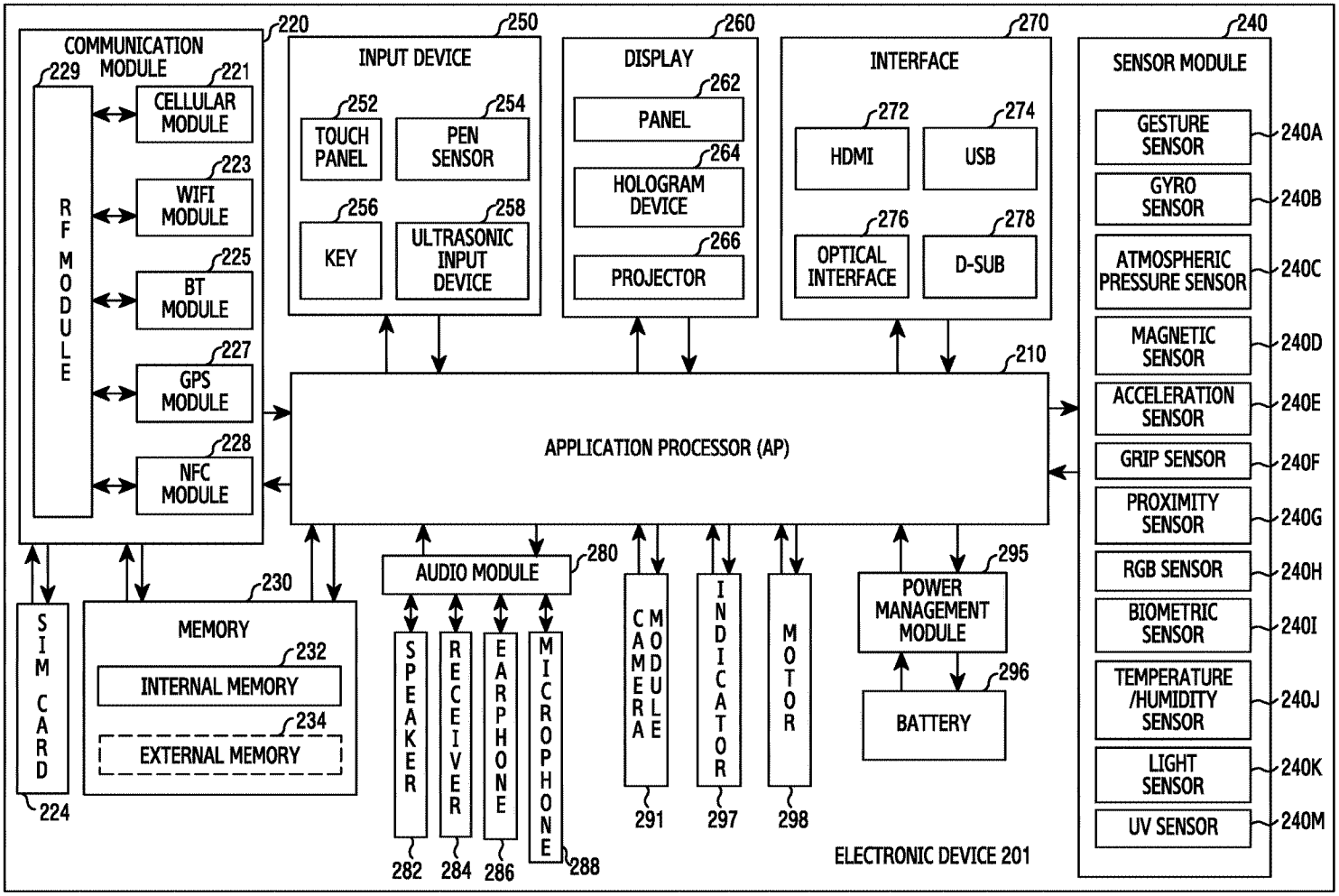
FIG. 2 is a block diagram of an electronic device according to various embodiments of the present disclosure.

The APs may control a plurality of hardware or software elements connected thereto and perform processing and operations on various types of data including multimedia data by driving an operating system or application programs (or applications). The APs may be embodied as, for example, a System on Chip (SoC). According to an embodiment such as shown in FIG. 2, the processor 210 may further include a graphic processing unit (GPU, not illustrated).

The MCUs may be processors configured to perform specified operations. According to an embodiment, the MCUs may acquire sensing information through one or more specified motion sensors (e.g., a gyro sensor, an acceleration sensor, and a geomagnetic sensor), compare the acquired sensing information, and determine the operating states of the specified sensors with reference to a database of the electronic device 101.

According to an embodiment, the APs or the MCUs may load instructions or data received from at least one of non-volatile memories or other elements connected thereto in volatile memories, and may process the loaded instructions or data. Furthermore, the APs or the MCUs may store data received from or generated by at least one of the other elements in non-volatile memories. An artisan understands that the APs and MCUs are not pure software, or software per se, and thus are statutory elements in accordance with 35 U.S.C. § 101.

The memory 130 (e.g., the memory 230) may be non-transitory memories that may store commands or data received from the processor 120 or other elements (e.g., the input/output interface 140, the display 150, and the communication interface 160) or generated by the processor 120 or other elements. The memory 130 may include programming modules, for example, a kernel 131, middleware 132, an application programming interface (API) 133, an application 134, and the like. The programming modules may be configured with software, firmware, hardware, or a combination of two or more thereof.

With continued reference to FIG. 1, the kernel 131 may control or manage system resources (e.g., the bus 110, the processor 120, the memory 132, and the like) that are used to execute operations or functions implemented in the remaining programming modules, for example, the middleware 133, the API 134, and the applications 134. Also, the kernel 131 may provide an interface that allows the middleware 132, the API 133, or the application 134 to access, control, or manage individual elements of the electronic device 101.

The middleware 132 may function as an intermediary that allows the API 133 or the applications 134 to communicate with the kernel 131 in order to exchange data. Furthermore, in connection with task requests received from the applications 134, the middleware 132 may perform a control (e.g., scheduling or load balancing) on the task requests by using, for example, a method of assigning a priority to use system resources of the electronic device 101 (e.g., the bus 110, the processor 120, the memory 130, or the like) to at least one of the applications 134.

The API 133, which is an interface for allowing the applications 134 to control functions provided by the kernel 131 or the middleware 132, may include, for example, at least one interface or function (e.g., an instruction) for a file control, a window control, image processing, a text control, or the like.

The applications 134 may include a short message service (SMS)/multimedia message service (MMS) application, an e-mail application, a calendar application, an alarm application, a health care application (e.g., application for measuring physical activity or blood glucose), and an environmental information application (e.g., application for providing atmospheric pressure, humidity, or temperature information). The applications 134 may include an application associated with the exchange of information between the electronic device 101 and an external electronic device (e.g. an electronic device 102 or 104). The application associated with the exchange of information may include, for example, a notification relay application for transferring specific information to an external electronic device or a device management application for managing an external electronic device. The notification relay application may, for example, include a function of transferring to an external electronic device (e.g., the electronic device 104), a notification information generated by other applications (e.g., an SMS/MMS application, an e-mail application, a health care application, or an environmental information application) of the electronic device 101. Additionally or alternatively, the notification relay application may receive notification information from, for example, an external electronic device (e.g., the electronic device 104) and provide the received notification information to a user. The device management application may, for example, manage (e.g., install, delete, or update) functions for at least a part of an external electronic device (e.g., the electronic device 104) communicating with the electronic device 101 (e.g., turning on/off the external electronic device itself (or some elements thereof) or adjusting the brightness (or resolution) of a display), applications operating in the external electronic device, or services (e.g., a telephone call service or a message service) provided by the external electronic device. According to various embodiments, the applications 134 may include an application specified according to the attribute (e.g., type) of an external electronic device (e.g., the electronic device 102 or 104). For example, in cases where an external electronic device is an MP3 player, the applications 134 may include an application relating to the reproduction of music. Similarly, in cases where an external electronic device is a mobile medical appliance, the applications 134 may include an application relating to health care. According to an embodiment, the applications 134 may include at least one of an application designated to the electronic device 101 and an application received from the external electronic device (e.g., a server 106 or the electronic device 104). Audio processing program 135 may be provided while included in the applications 134, or may be stored in the memory 130 as a separate program.

The audio processing program 135 may acquire battery status information on two or more element devices, determine whether the battery status information satisfies a reference condition, and control a function of at least one device among the two or more element devices. According to an embodiment, the audio processing program 135 may include, in the battery status information, at least one among information on the remaining amount of the battery, information on the battery consumption, information on the difference between the remaining amounts of two or more batteries, and information on the battery life. According to an embodiment, the audio processing program 135 may identify that the remaining amount of at least one battery has a value lower than a predetermined value or the difference between the remaining amounts of two or more batteries has a value higher than a predetermined value. According to an embodiment, the audio processing program 135 may control the function being performed by the first element device so as to be performed by a second element device. According to an embodiment, the audio processing program 135 may perform at least one operation of encoding audio input through at least one microphone, transmitting the data of the encoded audio to another electronic device, and reproducing and outputting the audio data received from the other electronic device. According to an embodiment, the audio processing program 135 may control the transmission of the audio data using a communication protocol of short-range wireless communication connected with another electronic device. According to an embodiment, the audio processing program 135 may stop the audio output that is being output through the element device when checking the voice of a specified user on the basis of a user profile. According to an embodiment, the audio processing program 135 may output the audio through the element device and audio received from another electronic device connected through short-range wireless communication.

The input/output interface 140 may transfer instructions or data, input from a user through an input/output device (e.g., various sensors, such as an acceleration sensor or a gyro sensor, and/or a device such as a keyboard or a touch screen), to the processor 120, the memory 130, or the communication interface 160 through the bus 110. For example, the input/output interface 140 may provide the processor 120 with data on a user's touch that is entered on a touch screen. Furthermore, the input/output interface 140 may output instructions or data, received from, for example, the processor 120, the memory 130, or the communication interface 160 via the bus 110, through an output unit (e.g., a speaker or the display 150). For example, the input/output interface 140 may output voice data processed by the processor 120 to a user through a speaker.

The display 150 may display various types of information (e.g., multimedia data or text data) to a user. In addition, the display 150 may be configured as a touch screen for inputting an instruction by touching or proximity-touching the touch screen.

The communication interface 160 (e.g., a communication module 220 shown in FIG. 2) may establish a communication connection between the electronic device 101 and an external device (e.g., the electronic device 104 or the server 106). For example, the communication interface 160 may be connected to a network 162 through wireless or wired communication to communicate with an external device. The wireless communication may include at least one of, for example, Wi-Fi, Bluetooth (BT), near field communication (NFC), a global positioning system (GPS), and cellular communication (e.g. LTE, LTE-A, CDMA, WCDMA, UMTS, WiBro, GSM, etc.). The wired communication may include at least one of, for example, a universal serial bus (USB), a high definition multimedia interface (HDMI), recommended standard 232 (RS-232), and a plain old telephone Service (POTS).

According to an embodiment, the network 162 may be a communication network. The communication network may include at least one of a computer network, the Internet, the Internet of Things, and a telephone network. According to an embodiment, at least one of the applications 134, the application programming interface 133, the middleware 132, the kernel 131, and the communication interface 160 may support a protocol (e.g., a transport layer protocol, a data link layer protocol, or a physical layer protocol) for communication between the electronic device 101 and an external device.

According to an embodiment, the server 106 may support the driving of the electronic device 101 by performing at least one of the operations (or functions) implemented in the electronic device 101. For example, the server 106 may include a server module (e.g., a server controller or a server processor, not illustrated) that may support the processor 120, which controls the electronic device 101 to perform various embodiments of the present disclosure to be described below or a specific module specified to perform the various embodiments. For example, the server module may include at least one element of the processor 120 or the specific module to perform at least one of the operations performed by the processor 120 or the specific module (e.g., perform the operations on behalf of the processor 120 or the specific module). According to various embodiments of the present disclosure, the server module may be embodied as the fingerprint processing server module 108 of FIG. 1.

An I/O device 170 may include at least one module from among audio processing modules such as a microphone, a speaker, an encoder, a decoder. According to an embodiment, the encoder may convert audio input through the microphone by applying a specified communication protocol. According to an embodiment, when connecting to another electronic device via a communication interface 160, the electronic device 101 may convert the audio based on the communication protocol of the network communication (for example, the communication protocol of BLE communication). According to an embodiment, the decoder may extract (or reconstruct) audio and/or voice signal from audio data received through the communication interface 160.

FIG. 2 to FIG. 10, which will be described hereinafter, may provide additional information on the electronic device 101.

FIG. 2 is a block diagram of an electronic device according to various embodiments of the present disclosure.

As shown in FIG. 2, the electronic device 201 may constitute, for example, the entirety or a part of the electronic device 101 illustrated in FIG. 1, or may expand all or some elements of the electronic device 101. Referring to FIG. 2, the electronic device 201 may include at least one processor 210, a communication module 220, a subscriber identification module (SIM) card 224, a memory 230, a sensor module 240, an input device 250, a display 260, an interface 270, audio module 280, a camera module 291, a power management module 295, a battery 296, an indicator 297, or a motor 298.

At least one processor 210 may be included in the electronic device 101 to perform a specified function of the electronic device 101. According to an embodiment, the processor 210 may include one or more application processors (APs) and one or more micro controller units (MCUs). According to another embodiment, the processor 210 may include one or more micro controller units as applications, or may be functionally connected to one or more micro controller units. In FIG. 1, the APs and the MCUs may be included in one IC package, or may be separately configured to be included in different IC packages, respectively. According to an embodiment, the MCUs may be included in an IC package of the APs to be configured as one IC package together with the APs. Although the processor 210 is illustrated as including the APs or the MCUs as elements thereof, such illustration is provided for explanatory, and it is apparent that the processor 210 may also perform the operations of the APs and/or the MCUs.

The APs may control a plurality of hardware or software elements connected thereto and perform processing and operations on various types of data including multimedia data by driving an operating system or application programs (or applications). The APs may be embodied as, for example, a System on Chip (SoC). According to an embodiment, the processor 210 may further include a graphic processing unit (GPU, not illustrated).

The MCUs may be processors configured to perform specified operations. According to an embodiment, the MCUs may acquire sensing information through one or more specified motion sensors (e.g., a gyro sensor 240*b*, an acceleration sensor 240*e*, or a geomagnetic sensor (not shown), compare the acquired sensing information, and determine the operating states of the specified sensors (e.g., geomagnetic sensor) with reference to a database of the electronic device 101. In addition, although the MCUs and the elements of the sensor module 140 are illustrated as separate elements in FIG. 1, the MCUs may be implemented to include at least some elements of the aforementioned sensor module 240 (e.g., at least one of the gyro sensor 240*b*, the acceleration sensor 240*e*, and the geomagnetic sensor) according to an embodiment.

According to an embodiment, the APs or the MCUs may load instructions or data received from at least one of non-volatile memories or other elements connected thereto in volatile memories, and may process the loaded instructions or data. Furthermore, the APs or the MCUs may store data received from or generated by at least one of the other elements in non-volatile memories.

The wireless communication module 220 (e.g., the communication interface 160) may perform data transmission/reception in communication between the electronic device 101 and other electronic devices (e.g., the electronic device 102 or 104, or the server 106) connected thereto through a network. According to an embodiment, the communication module 220 may include a cellular module 221, a Wi-Fi module 223, a BT module 225, a GPS module 227, an NFC module 228, and a Radio Frequency (RF) module 229. The various wireless communication modules include hardware such as a transmitter, receiver, transceiver, antenna or antenna array.

The cellular module 221 may provide a voice call service, a video call service, a text message service, or an Internet service through a communication network (e.g., Long Term Evolution (LTE), LTE-A, Code Division Multiple Access (CDMA), Wideband CDMA (WCDMA), Universal Mobile Telecommunication System (UMTS), Wireless Broadband (WiBro), or Global System for Mobile communication (GSM)). Furthermore, the cellular module 221 may, for example, distinguish between and authenticate electronic devices within a communication network using a subscriber identification module (e.g., the SIM card 224). According to an embodiment, the cellular module 221 may perform at least some of the functions that the AP 210 may provide. For example, the cellular module 221 may perform at least some of the multimedia control functions.

According to an embodiment of the present disclosure, the cellular module 221 may include a communication processor (CP). Furthermore, the cellular module 221 may be embodied as, for example, an SoC. Although the elements such as the cellular module 221 (e.g., a communication processor), the memory 230, and the power management module 295 are shown as being arranged separate from the AP 210 in FIG. 2. However, the power management module may not be separate from the AP 210, and may be implemented to include at least some of the aforementioned elements (e.g., the cellular module 221) according to an embodiment.

According to another embodiment, the AP 210 or the cellular module 221 (e.g., the communication processor) may load instructions or data received from at least one of non-volatile memories or other elements connected thereto in volatile memories, and may process the loaded instructions or data. Furthermore, the AP 210 or the cellular module 221 may store data received from or generated by at least one of the other elements in a non-volatile memory.

With further regard to the communication module 220, the Wi-Fi module 223, the BT module 225, the GPS module 327, and the NFC module 228 may include a processor for processing data transmitted/received through the corresponding module. In FIG. 2, the cellular module 221, the Wi-Fi module 223, the BT module 225, the GPS module 227, and the NFC module 228 are illustrated as separate blocks. However, according to an embodiment, at least some (e.g., two or more) of the cellular module 221, the Wi-Fi module 223, the BT module 225, the GPS module 227, and the NFC module 228 may be included in one integrated chip (IC) or one IC package. For example, at least some of the processors corresponding to the cellular module 221, the Wi-Fi module 223, the BT module 225, the GPS module 227, and the NFC module 228 (e.g., a communication processor corresponding to the cellular module 221 and a Wi-Fi processor corresponding to the Wi-Fi module 223) may be implemented as one SoC.

The RF module 229 may transmit/receive data, for example, RF signals via a transmitter, receiver, or transceiver. Although not illustrated, the RF module 229 may, for example, include a transceiver, a power amp module (PAM), a frequency filter, a low noise amplifier (LNA), or the like. In addition, the RF module 229 may further include an element (e.g. an antenna) for transmitting/receiving electronic waves over free air space in wireless communication, such as, a conductor, a conducting wire, or the like. In FIG. 2, the cellular module 221, the Wi-Fi module 223, the BT module 225, the GPS module 227, and the NFC module 228 share one RF module 229. However, according to an embodiment, at least one of them may transmit/receive an RF signal through a separate RF module.

The SIM card 224 may be a card that includes a subscriber identification module, and may be inserted into a slot formed in a specific location of the electronic device. The SIM card 224 may include unique identification information (e.g., an integrated circuit card identifier (ICCID)) or subscriber information (e.g., an international mobile subscriber identity (IMSI)).

The memory 230 (e.g., the memory 130) may include an internal memory 232 or an external memory 234. The internal memory 232 may include at least one of, for example, a volatile memory (e.g., a dynamic random access memory (DRAM), a static RAM (SRAM), a synchronous dynamic RAM (SDRAM), or the like) or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a NAND flash memory, a NOR flash memory, or the like).

According to an embodiment, the internal memory 232 may be a solid state drive (SSD). The external memory 234 may further include a flash drive, for example, a compact flash (CF), a secure digital (SD), a micro secure digital (Micro-SD), a mini secure digital (Mini-SD), an extreme digital (xD), a Memory Stick, or the like. The external memory 234 may be functionally connected to the electronic device 201 through various interfaces. According to an embodiment, the electronic device 201 may further include a storage device (or storage medium) such as a hard disc drive.

The sensor module 240 may measure a physical quantity or sense an operating state of the electronic device 201, and may convert/transduce the measured or sensed information into an electric signal. The sensor module 240 may include at least one of, for example, a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., red, green, and blue (RGB) sensor), a biometric sensor 240I, a temperature/humidity sensor 240J, an illumination sensor 240K, and a Ultra Violet (UV) sensor 240M. Additionally or alternatively, the sensor module 240 may, for example, include an E-nose sensor (not shown), an electromyography (EMG) sensor (not shown), an electroencephalogram (EEG) sensor (not shown), an electrocardiogram (ECG) sensor (not shown), an Infrared (IR) sensor (not shown), an iris sensor (not shown), a fingerprint sensor (not shown), and the like, just to name some non-limiting possibilities. The sensor module 240 may further include a control circuit for controlling one or more sensors included therein.

The input device 250 may include a touch panel 252, a (digital) pen sensor 254, a key 256, or an ultrasonic input device 258. The touch panel 252 may detect a touch input in at least one of, for example, a capacitive type, a resistive type, an infrared type, and an acoustic wave type. The touch panel 252 may further include a control circuit. In case of the capacitive type touch panel, physical contact or proximity detection is possible. The touch panel 252 may further include a tactile layer. In this case, the touch panel 252 may provide a user with a tactile reaction.

The (digital) pen sensor 254 may be implemented, for example, using the same or a similar method to receiving a user's touch input or using a separate detection sheet. The key 256 may include, for example, a physical button, an optical key, or a keypad. The ultrasonic input device 258 may identify data by detecting an acoustic wave with a microphone (e.g., a microphone 288) of the electronic device 201 through an input unit generating an ultrasonic signal, and may perform wireless detection. According to an embodiment, the electronic device 201 may also receive a user input from an external device (e.g., a computer or server) connected thereto using the communication module 220.

The display 260 (e.g., the display 150) may include a panel 262, a hologram device 264, or a projector 266. The panel 262 may be, for example, a Liquid Crystal Display (LCD), an Active Matrix Organic Light Emitting Diode (AM-OLED), on any Thin Film Technology constructions, or the like. The panel 262 may be implemented to be, for example, flexible, curved, transparent, or wearable. The panel 262 may be formed as a single module together with the touch panel 252. The hologram device 264 may show a three dimensional image in the air using an interference of light. The projector 266 may display an image by projecting light onto a screen. The screen may be located, for example, in the interior of electronic device 201, or on the exterior of the electronic device 201. According to an embodiment, the display 260 may further include a control circuit for controlling the panel 262, the hologram device 264, or the projector 266.

The interface 270 may include, for example, a High-Definition Multimedia Interface (HDMI) 372, a Universal Serial Bus (USB) 274, an optical interface 276, or a D-sub-miniature (D-sub) 278. The interface 270 may be included in, for example, the communication interface 160 illustrated in FIG. 1. Additionally or alternatively, the interface 270 may include, for example, a Mobile High-definition Link (MHL) interface, a Secure Digital (SD) card/Multi-Media Card (MMC) interface, or an Infrared Data Association (IrDA) standard interface.

The audio module 280 may bilaterally convert a sound and an electrical signal. At least some elements of the audio module 280 may be included in, for example, the input/output interface 140 illustrated in FIG. 1. The audio codec 280 may process voice information input or output through, for example, a speaker 282, a receiver 284, earphones 286, or the microphone 288. The camera module 291 is a device for capturing still and moving images, and may include one or more image sensors (e.g., a front sensor or a rear sensor), a lens (not illustrated), an image signal processor (ISP, not illustrated), or a flash (e.g., an LED or a xenon lamp, not illustrated) according to an embodiment.

The power management module 295 may manage the power usage of the electronic device 201. Although not illustrated, the power management module 295 may include, for example, a Power Management Integrated Circuit (PMIC), a charger Integrated Circuit (IC), or a battery or fuel gauge. According to various embodiments, the PMIC may be mounted to an integrated circuit or an SoC semiconductor. Charging methods may be classified into a wired charging method and a wireless charging method. The charger IC may charge a battery and may prevent an overvoltage or excess current from being induced or flowing from a charger.

According to an embodiment, the charger IC may include a charger IC for at least one of the wired charging and the wireless (contactless) charging. Examples of the wireless charging may include magnetic resonance charging, magnetic induction charging, and electromagnetic charging, and an additional circuit such as a coil loop, a resonance circuit, and a rectifier may be added for the wireless charging.

The battery gauge may measure, for example, a residual quantity of the battery 296, and a voltage, a current, or a temperature while charging. The battery 296 may store or generate electricity and may supply power to the electronic device 201 using the stored or generated electricity. The battery 296 may include, for example, a rechargeable battery or a solar battery.

The indicator 297 may display a specific state of the electronic device 201 or a part thereof (e.g., the AP 210), for example, a boot-up state, a message state, or a state of charge (SOC). A motor 298 may convert an electrical signal into a mechanical vibration. Although not illustrated, the electronic device 201 may also include a processing device (e.g., a GPU) for supporting mobile TV. The processing unit for supporting mobile TV may process, for example, media data pursuant to a certain standard of Digital Multimedia Broadcasting (DMB), Digital Video Broadcasting (DVB), or media flow.

Each of the above described elements of the electronic device according to various embodiments of the present disclosure may include one or more components, and the name of a corresponding element may vary according to the type of electronic device. The electronic device according to various embodiments of the present disclosure may include at least one of the above described elements and may exclude some of the elements or further include other additional elements. Further, some of the elements of the electronic device according to various embodiments of the present disclosure may be coupled to form a single entity while performing the same or similar functions as those of the corresponding elements before the coupling.

Figure 3:
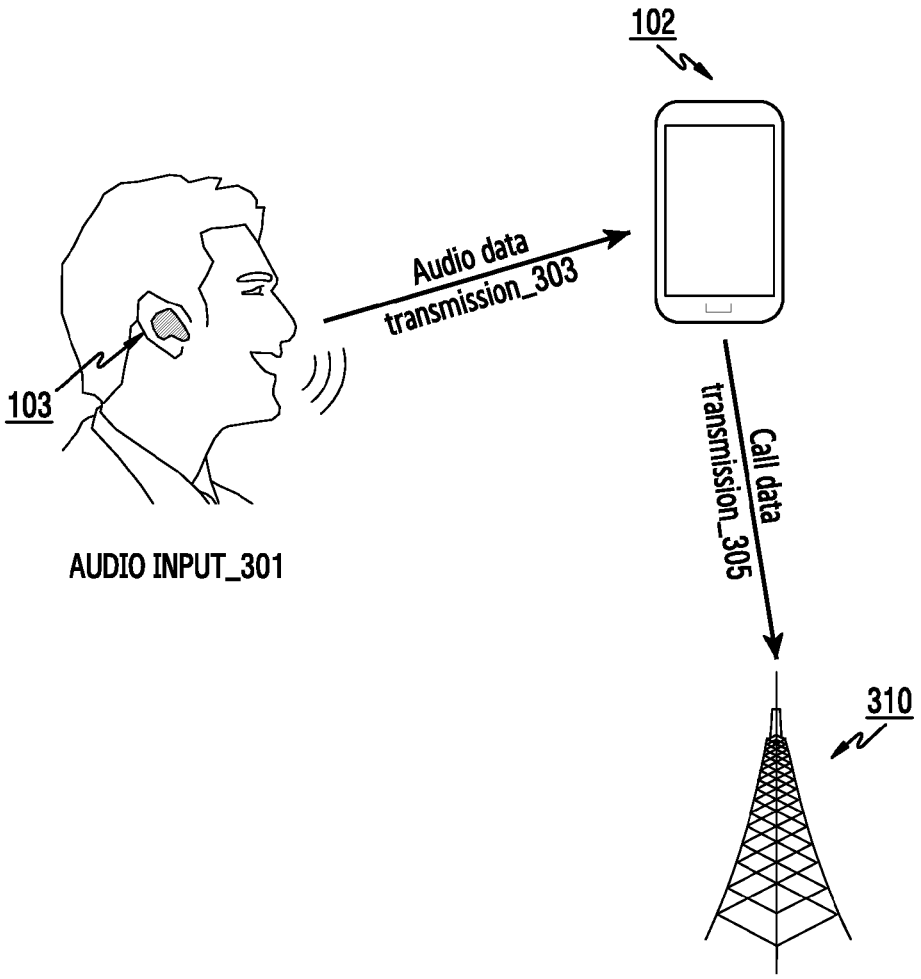
FIG. 3 shows an operation of processing an input audio by an electronic device according to various embodiments of the disclosure.

FIG. 3 shows an operation of processing an input audio by an electronic device according to various embodiments of the disclosure.

According to various embodiments of the disclosure, electronic device 101 may include at least one transducer, such as a microphone. The electronic device 101 may convert (e.g., amplify) audio input through a microphone based on a user profile stored in the memory and output the converted audio input through a speaker. According to an embodiment, the electronic device 101 may perform the role of the hearing aid device (or a hearing device and hearing aids). According to various embodiments, the electronic device 101 may include a communications interface 160 and output to the speaker, an audio signal received from another electronic device connected through a short-range wireless communication (for example, the electronic device 102 and/or 103). According to an embodiment, the electronic device 101 may decode and/or amplify the received audio data based the user profile and output the decoded and/or amplified audio data to the speaker. In addition, the electronic device 101 may include an encoder. The electronic device 101 may encode the audio input through the microphone and transmit the encoded audio data to at least one other electronic device (e.g., the electronic device 102 and/or an electronic device 103) connected by short-distance wireless communication through the communication interface 160.

According to various embodiments of the disclosure, the electronic device 101 may be attached to the user's ear to perform the function of a hearing aid device. When performing a call function using at least one electronic device (e.g., the electronic device 102) possessed by the user, the electronic device 101 may perform the role of hands-free device assisting the call function of the electronic device 102.

According to an embodiment of the disclosure, the electronic device 101 may receive audio data through short-range wireless communication, the audio data being received during a call connected with an electronic device (for example, an electronic device 103) of another user, using the electronic device 102 possessed by the user. The electronic device 101 may decode and/or amplify the received audio data based on the user profile and output the decoded and/or amplified audio data through the speaker.

According to an embodiment of the disclosure, the electronic device 101 may encode, during the performance of the role of a hands-free device, the audio input through the microphone included in the electronic device 101. The electronic device 101 may encode the audio input through the microphone and generate the specified type of audio data. The electronic device 101 may transmit the encoded audio to the electronic device 102 via short-range wireless communication. The electronic device 102 may transmit, through the communication interface 160, the audio data received from the electronic device 101, to the electronic device 103 being in a state of communication.

Figure 4:
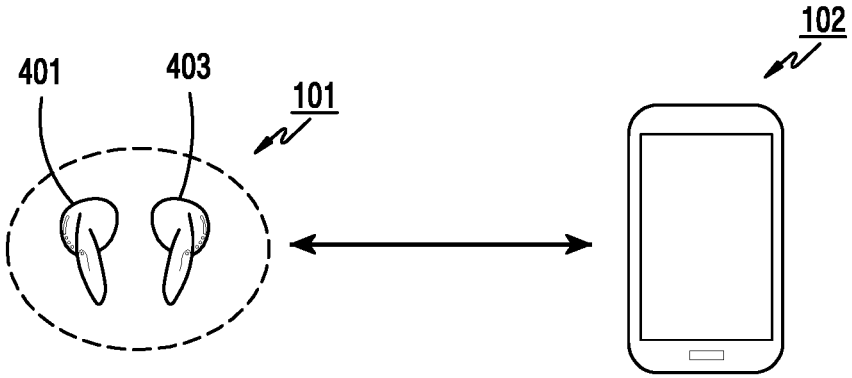
FIG. 4 shows an operation of controlling at least one module by an electronic device according to various embodiments of the disclosure.

FIG. 4 shows an operation of controlling at least one module by an electronic device according to various embodiments of the disclosure.

According to various embodiments, the electronic device 101 may be a monaural device configured by a single device or a binaural device configured by two devices connected with each other. In addition, the electronic device 101 may include three or more devices. When the electronic device 101 is configured for a binaural hearing aid device, the hearing aid device may be individually attached on the user's ears (e.g. a left ear and a right ear). When the electronic device 101 is configured for a binaural hearing aid device, the binaural hearing aid device may be described as having a first element device 401 and a second element device 403. The electronic device 101 may include a processor 120 arranged in at least one device of the first element device 401 and the second element device 403. The first element device 401 and the second element device 403 of the electronic device 101 may include at least one communication interface, a battery, a speaker, a microphone, and an encoder, respectively. At least one processor included in the first element device 401 or the second element device 403 of the electronic device 101 may perform the role of a main processor, control another processor, or request to perform the function specified by the other processor. The electronic device 101 may transmit and receive data using short-range wireless communication or wired communication connected between the first element device 401 and the second element device 403.

According to various embodiments, the electronic device 101 may change the configuration of the electronic device 101 (for example, electronic device 102) through at least one other electronic device connected through short-range wireless communication. According to an embodiment, the electronic device 101 may acquire the device status information of the electronic device 101 based on at least one sensor. Here, the device status information may include information on the amount of battery consumption, information on the amount of remaining battery power, information on battery life, and information on the difference between the amounts of remaining power of two or more batteries. For example, the electronic device 101 may acquire information on the amount of remaining battery power included in at least one of the element device (e.g., the first element device 401 and/or the second element device 403). The electronic device 101 may compare the acquired amounts of remaining battery power between the first element device 401 and the second element device 403. When the difference between the compared remaining amounts of battery power has a value higher than a predetermined value, or the remaining amount of battery power of at least one element device has a value lower than a predetermined value, the electronic device 101 may exchange a function executed in the first element device 401 and a function executed in the second element device 403. According to an embodiment, while encoding the audio input through the microphone of the first element device 401 and transmitting, through the communication interface, the encoded audio to the electronic device 102, when the remaining amount of battery power included in the first element device 401 has a value lower than a predetermined value (e.g., 20%), the electronic device 101 may control the electronic device 102 to perform the operation of encoding the audio input through the microphone and transmitting the encoded audio to the second element device 403 through the communication interface. According to an embodiment, when the remaining amount of the battery included in the second element device 403 is more than the remaining amount of the battery contained in the first element device 401, the electronic device 101 may perform the above operations of controlling the electronic device 102 to perform encoding the audio input through the microphone and transmitting the encoded audio to the second element device 403 through the communication interface. According to an embodiment of the disclosure, the electronic device 101 may acquire the device status information, such as, information on the remaining amount of the battery included in at least one of the element devices (e.g., the first element device 401 and/or the second element device 403), information on the function being operated in the first element device 401, and/or information on the function being operated in the second element device, and transmit the acquired device status information to the electronic device 102 connected through short-range wireless communication.

According to various embodiments, the electronic device 102 may receive the device status information of the electronic device 101 transmitted from the electronic device 101 connected through short-range wireless communication. According to various embodiments, the electronic device 102 may receive information on the amount of remaining battery power in the electronic device 101 from the electronic device 101 connected through short-range wireless communication. For example, the information on the amount of battery remaining received from electronic device 101 may be information on the amount of battery remaining included in at least one element device among the first element device 401 and/or the second element device 403. The electronic device 102 may identify a predetermined condition (or standard condition) on the basis of the configuration information, such as, a condition where the amount of remaining battery power in the element device has a value lower than a predetermined value or a condition where the difference between batteries remaining amounts of each element device has a value higher than a predetermined value. The electronic device 102 may transmit a message that controls a function being performed by the electronic device 101 on the basis of the configuration information, when the amount of remaining battery power has a value lower than a predetermined value or the difference between the amounts of remaining battery power of each element device has a value higher than a predetermined value. According to an embodiment, when the received amount of remaining battery power is determined to be lower than a predetermined value, the electronic device 102 may transmit, to the first electronic device 101, a message which controls the volume of a speaker of the electronic device 101 (e.g., a speaker included in the first element device 401 and/or the second element device 403).

According to an embodiment, when the amount of remaining battery power in the first element device 401 is identified to be lower than, by a predetermined value, the amount of remaining battery power in the second element device 403, the electronic device 102 may transmit, to the first electronic device 401, a message for controlling the second element device 403 to transmit the audio data, which is transmitted by the first device 401, through the communication interface. On the other hand, the electronic device 102 may transmit, to the electronic device 101, a message for controlling the second element device 403 to perform an operation of encoding the audio input through the microphone of the electronic device 101 (e.g., microphones included in the first element device 401 and/or second element device 403), which is being performed by the electronic device 101.

The electronic device 101 may control an operation performed by the first element device 401 and/or the second element device 403 based on the received control message. According to various embodiments of the present disclosure, although the electronic device 101 is mainly described to perform the role of the hearing aid device, but it is not limited thereto, it is obvious to perform the role of the electronic device 102 based on the device status information received by connecting at least one other electronic device through short-range wireless communication.

According to an embodiment, the electronic device 101 may check an operation of a call origination or a call reception while receiving audio data (for example, songs) from another electronic device (for example, the electronic device 102) connected through short-distance wireless communication, and reproducing and outputting the audio data. The electronic device 101 may stop the reproduction and/or output of the audio data being reproduced and output in order to perform the role of a hands-free device during a call of the electronic device 102, which is connected through short-range wireless communication.

According to an embodiment, when it is identified that the specified audio (for example, a voice of a user) is input through one microphone included in the electronic device 101 while receiving audio data (for example, songs) from another electronic device (for example, the electronic device 102) connected through short-distance wireless communication, and reproducing and outputting the audio data, the electronic device 101 may stop the reproduction and/or output of the audio data being reproduced and output. The electronic device 101 may determine whether the audio input to the microphone is a particular user's voice based on audio information specified in the user's profile. The electronic device 101 may perform the role of a hearing aid device based on the input audio.

Figure 5:
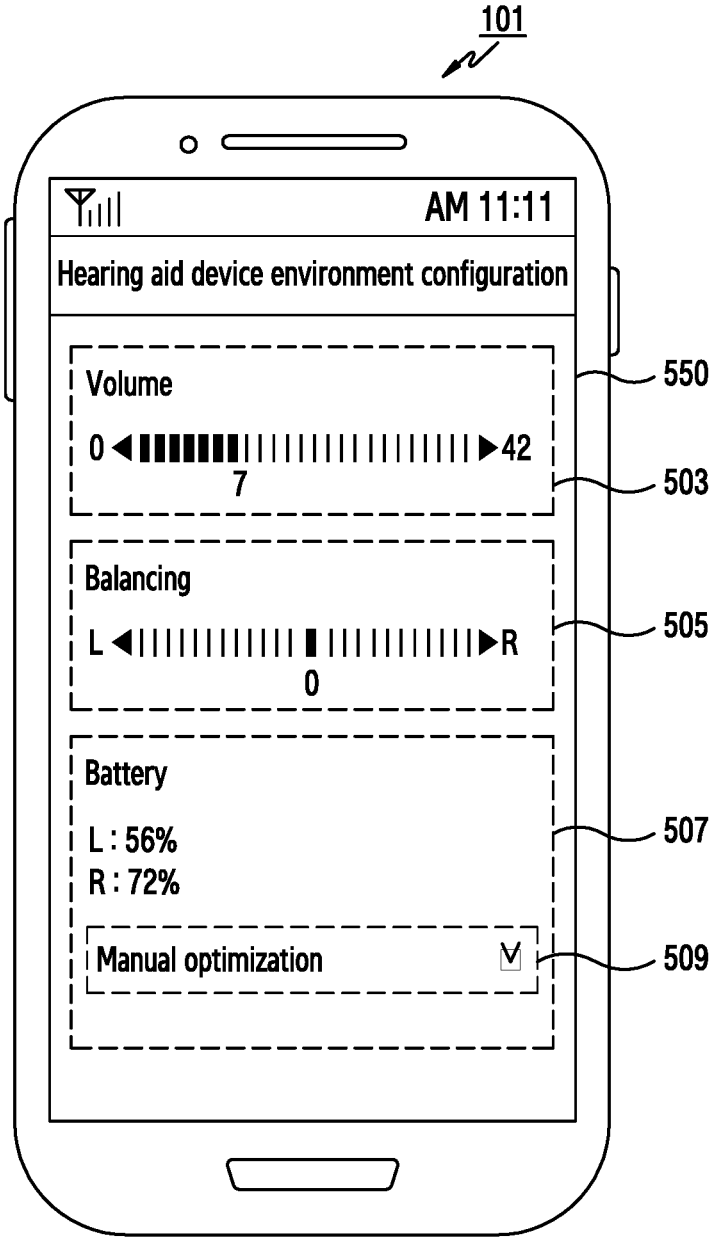
FIG. 5 shows an operation of processing the received information by an electronic device according to various embodiments of the disclosure.

FIG. 5 shows an operation of processing the received information by an electronic device according to various embodiments.

According to various embodiments, the electronic device 101 may perform the operations of the electronic device 102 as described above in FIG. 4. According to an embodiment, the electronic device 101 may be connected to at least one hearing aid device through short-range wireless communication and receive the device status information from the hearing aid device. The electronic device 101 may generate a message for controlling the hearing aid device and transmit the generated control message to the hearing aid device based on the received device status information of the hearing aid device and/or the configuration information of the electronic device 101. The electronic device 101 may provide a function for generating a control message based on the device status information received from the hearing aid device. According to an embodiment, the electronic device 101 may provide a hearing aid device environment configuration menu 501 which configures a function or an environment of the hearing aid device connected through short-range wireless communication. The electronic device 101 may configure the function and/or the environment of the hearing aid device, such as volume information and balancing information of the hearing aid device, battery information and optimization, through the environment configuration menu 501

Referring now to FIG. 5, the electronic device 101 may provide a function 503 capable of controlling the volume of the hearing aid device through the environment configuration menu 501. The electronic device 101 may configure specific volume information based on the user's input and transmit, to the hearing aid device, the control message for controlling the volume of the hearing aid device based on the configured information.

According to an embodiment, the electronic device 101 may provide a function 505 capable of controlling the balance of the hearing aid device through the environment configuration menu 501. The electronic device 101 may transmit a control message for controlling the balance of the binaural hearing aid device to the hearing aid device based on the user's input-based configured balancing information According to an embodiment, the electronic device 101 may provide a function 507 capable of displaying the battery information of the hearing aid device through the environment configuration menu 501. When displaying the battery information of the hearing aid device, the electronic device 101 may receive the device status information including information on the battery remaining amount by requesting the hearing aid device for the information on the battery remaining amount based on a periodic time interval or a user's input. The electronic device 101 may acquire information on the amount of battery remaining of the hearing aid device based on the received device status information and display 507 the acquired battery remaining amount information. The electronic device 101 may control, when configuring a function such as manual optimization 509, the functions of the hearing aid device based on the specified configuration information. According to an embodiment, the electronic device 101 may control the functions of the hearing aid device so as to reduce the battery consumption deviation of the binaural hearing aid device based on information regarding the remaining amount of battery power. For example, when the battery is consumed faster than a predetermined value based on the received device status information, the electronic device 101 may operate to reduce the consumption deviation in using the battery of the hearing aid device, by transmitting a control message to control an operation of the functions of the hearing aid device that consumes the battery, such as, a speaker function, a communication function, encoding, decoding, the microphone function of the corresponding element device.

In addition, the electronic device 101 may display, on a display 550 (e.g., the display 150 of electronic device 101), the information of the hearing aid device based on the device status information received from the hearing aid device.

Figure 6:
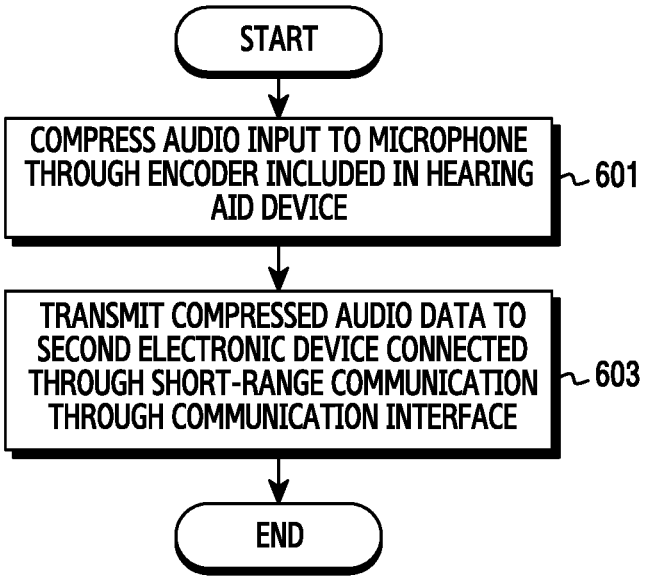
FIG. 6 is a flow chart illustrating an operational example of processing audio by an electronic device according to various embodiments of the disclosure.

FIG. 6 is a flow chart illustrating an operational example of processing audio by an electronic device according to various embodiments of the disclosure.

Referring now to operation 601, the electronic device 101 may compress audio input to the microphone through at least one encoder. According to an embodiment, the electronic device 101 may be a binaural hearing aid device. The electronic device 101 may include a first element device (for example, the element device 401 of FIG. 4) and a second element device (for example, the element device 403 of FIG. 4), and each of the element devices may include a microphone. Further, the electronic device 101 may include an encoder capable of encoding audio input, through the microphone, to at least one device of the element device 401 and the element device 403. The electronic device 101 may encode the audio input through the microphone and generate the specified type of audio data. According to an embodiment, the electronic device 101 may compress the input audio as data of a specified communication protocol. For example, the electronic device 101 may be in a state of being connected with at least one other electronic device (for example, the electronic device 102) through short-range wireless communication. When transmitting audio to the electronic device 102 connected through short-range wireless communication, the electronic device 101 may encode the audio into data corresponding to the communication protocol of the short range wireless communication. According to an embodiment of the disclosure, when the electronic device 101 is connected to the electronic device 102 through BLE communication, the electronic device 101 may encode the audio input through the microphone using the communication protocol of the BLE communication.

According to various embodiments of the disclosure, when encoding the audio input to the microphone, the electronic device 101 may filter a specific range of audio frequencies. For example, the electronic device 101 may include a microphone for each of the element device 401 and element device 403, compare audios input to respective microphones, and filter the frequency range of audio that is determined as noise.

Referring now to operation 603, the electronic device 101 may transmit audio data generated through the communication interface to the electronic device 102. According to an embodiment of the disclosure, the electronic device 101 may transmit, to the electronic device 102, the generated audio data through a communication interface included in at least one of the element device 401 and the element device 403. For example, when transmitting the generated audio data to the electronic device 102, the electronic device 101 may determine an element device having a higher amount of battery remaining with reference to the remaining amounts in the battery included in the element device 401 and/or the element device 403, and may transmit audio data through the communication interface of the element device having a higher amount of battery remaining. According to various embodiments, when transmitting the audio data through the communication interfaces of both the element device 401 and the element device 403, the electronic device 101 may control the transmission the audio data by more using the communication interface of the element device having a higher amount of battery remaining or by using a relatively large output.

The electronic device 101 may end the embodiment of FIG. 6 after performing the operation 601.

Figure 7:
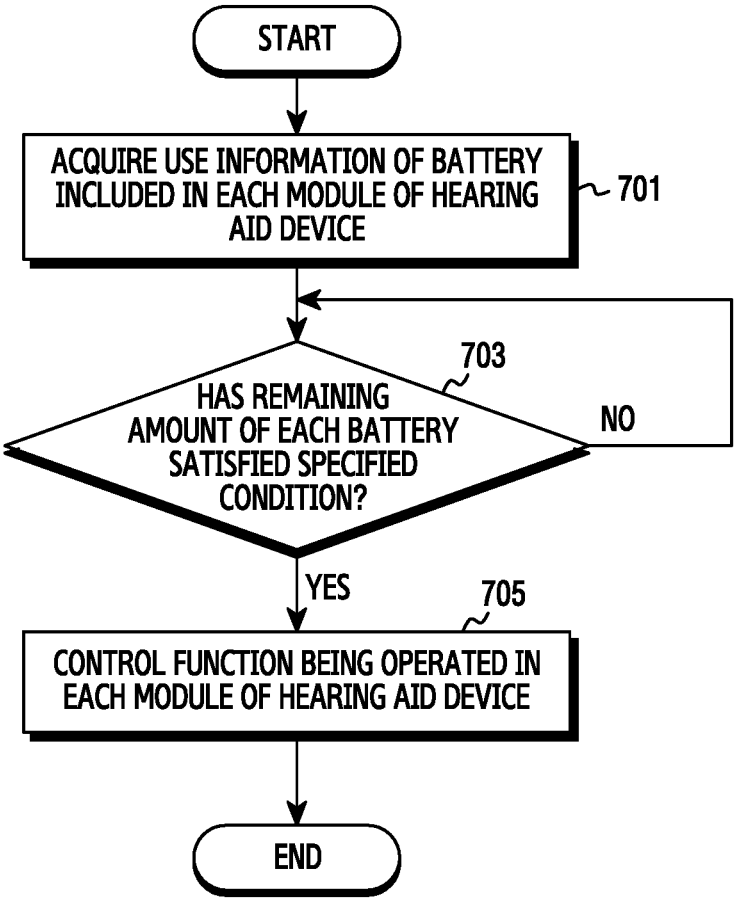
FIG. 7 is a flow chart illustrating an operational example of controlling, by an electronic device, a function based on information on the amount of battery power according to various embodiments of the disclosure.

FIG. 7 is a flow chart illustrating an operational example for controlling a function based on information on the amount of battery remaining in an electronic device according to various embodiments.

Referring now to operation 701, the electronic device 101 may identify information on the remaining amounts of the battery and/or information on the function being operated in the electronic device 101. According to an embodiment, when the electronic device 101 is a binaural hearing aid device, the electronic device 101 may include a first element device (for example, the element device 401 of FIG. 4) and a second element device (for example, the element device 403 of FIG. 4), and at least one of the element devices may include a battery. The electronic device 101 may include device status information, such as, information on the remaining amount of the battery included in respective element devices (e.g., the element device 401 and the element device 403), information on the functions being operated in respective element devices, information on the battery consumption amount of the functions being operated in the respective element devices.

Referring now to operation 703, the electronic device 101 may determine whether the identified remaining amount of battery satisfies a predetermined value. According to an embodiment, the electronic device 101 may identify the difference between the remaining amounts of the batteries included in the element device 401 and the element device 403, and determine whether the difference between the identified amount of remaining batteries has a value higher than a predetermined value (e.g., 10%). According to another embodiment, the electronic device 101 may determine whether at least one remaining amount of battery, from among the battery remaining amount value of the acquired element device 401 and element device 403, has a value lower than a predetermined value (e.g., 20%). In addition to the methods described above, the electronic device 101 may determine whether the remaining amount of battery of the acquired element device satisfies the predetermined value.

Referring now to operation 705, when a value of the battery remaining amount satisfies a predetermined value, the electronic device 101 may control, the functions being performed by the element device 401 and the element device 401 based on the status information. According to an embodiment, the electronic device 101 may control the operation of the function of consuming the battery in the element device that has relatively less battery remaining. For example, the electronic device 101 may encode the audio to be input to the microphone of the electronic device 101 through the element device 401. The electronic device 101 may check information on the amount of remaining battery, and when the difference between the amount of remaining battery has a value higher than a predetermined value, the electronic device 101 may control the encoding of the audio to be input to the microphone of the electronic device 101 through the encoder included in the element device 403. The electronic device 101 may control, as described above, the function operating in the element device 401 and/or the element device 403, and adjust the consumption of battery.

The electronic device 101 may end the embodiment of FIG. 7 after performing operation 705.

Figure 8:
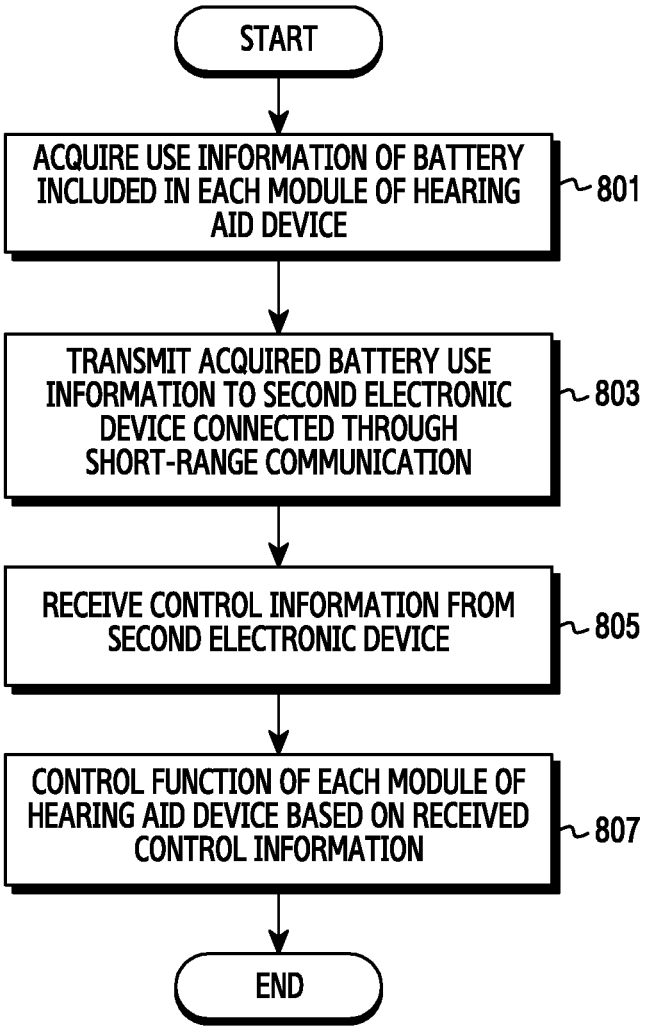
FIG. 8 is a flow chart illustrating an operation of controlling, by an electronic device, a function based on information on the amount of battery power according to various embodiments of the disclosure.

FIG. 8 is a flow chart illustrating an operational example for controlling a function based on the amount of battery power information by an electronic device according to various embodiments.

Referring now to operation 801, the electronic device 101 may identify information on the remaining amounts of the battery and/or information on the function being operated in the electronic device 101. According to an embodiment, when the electronic device 101 is a binaural hearing aid device, the electronic device 101 may include a first element device (for example, the element device 401 of FIG. 4) and a second element device (for example, the element device 403 of FIG. 4), and at least one element device of the element devices may include a battery. The electronic device 101 may include device status information, such as, remaining battery amount information that is included in each of the element devices (e.g., the element device 401 and the element device 403), the function information being operated in each of the element devices, battery consumption amount information of the function being operated in each of the element devices.

Referring now to operation 803, the electronic device 101 may transmit the acquired battery usage information to the electronic device 102 connected through short-range wireless communication. When transmitting the battery usage information, the electronic device 101 may transmit the battery use information by including at least one battery remaining amount information of the element device 401 and/or the element device 403. The electronic device 101 is not limited to the transmission of the information on the battery and may transmit the battery information along with information on operations being performed by the electronic device 101.

Referring now to operation 805, the electronic device 101 may receive a control message from the electronic device 102 which has been transmitted the device status information. According to an embodiment, the electronic device 102 may generate a control message that controls the electronic device 101 based on the received device status information and/or the configuration information of the electronic device 102. The electronic device 102 may transmit the generated control message to the electronic device 101.

Referring now to operation 807, the electronic device 101 may control, based on the received control message, functions operating in electronic device 101. According to an embodiment, when the remaining amount of battery of the element device 401 is less than the remaining amount of battery of the element device 403, and the difference between the remaining amounts of battery has a value higher than a predetermined value, the electronic device 101 may control the operation being performed by the first element device 401 based on the received control message and thus reduce the battery consumption amount. For example, the electronic device 101 may control the performance of, by the element device 403, the encoding operation being performed by the element device 401 according to the received control message.

In addition, the electronic device 101 may transmit/receive data to/from the electronic device 102 using short-range wireless communication via a communication interface of the first element device 401, and when encoding audio through the encoder of the second element device 403, the electronic device 101 may exchange operations performed by respective element devices based on the received control message. For example, the electronic device 101 may encode the audio through the encoder of the element device 401 according to the control message, and may control transmitting/receiving the data to/from the electronics 102 through the communication interface of the element device 403. As described above, the electronic device 101 may efficiently use the battery of the electronic device 101 by controlling the operations performed by respective element devices.

In addition, the electronic device 101 may receive audio of another electronic device that is in a communication state with the electronic device 102 connected through short distance wireless communication, and the electronic device 101 may record the communication contents between the electronic device 101 and the electronic device 102 by encoding the audio input through the microphone. The electronic device 101 may transmit the recorded communication data to a separate memory (e.g., a server 106) and store the data therein.

Upon completing operation 807, the electronic device 101 may end the embodiment of the present disclosure shown in FIG. 8.

Figure 9:
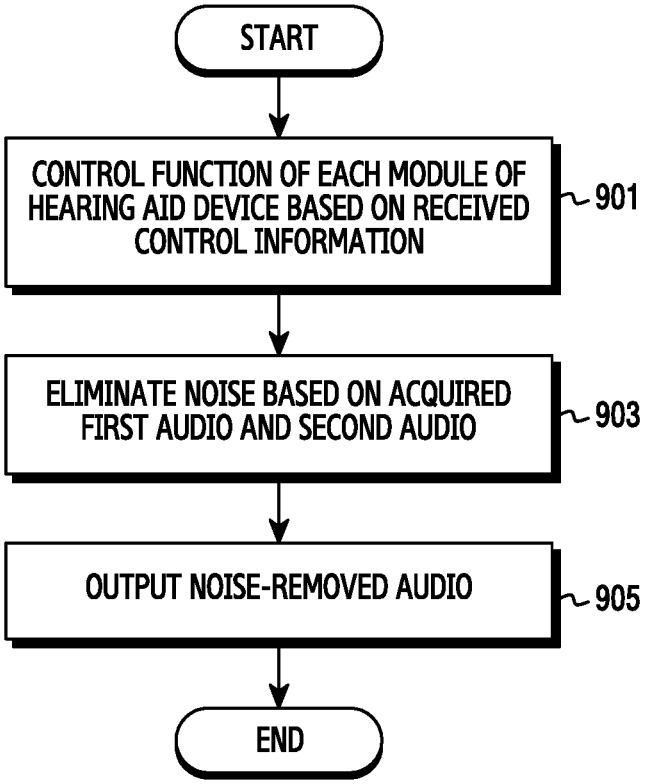
FIG. 9 is a flow chart illustrating an operational example of processing, by an electronic device, audio input through a microphone according to various embodiments of the disclosure.

FIG. 9 is a flow chart illustrating an operational example of processing audio input through a microphone by an electronic device according to various embodiments.

According to various embodiments of the disclosure, the electronic device 101 may be a binaural hearing aid device, and the electronic device 101 may include a first element device (for example, the element device 401 of FIG. 4) and a second element device (for example, the element device 403 of FIG. 4). Each of the element devices may include at least one of the encoder and the microphone.

Referring now to operation 901, the electronic device 101 may input audio through a first microphone and a second microphone. According to an embodiment, the electronic device 101 may be a binaural hearing aid device. The electronic device 101 may include a first element device (for example, the element device 401 of FIG. 4) including a first microphone and a second element device (for example, the element device 403 of FIG. 4) including the second microphone. The electronic device 101 may acquire a first audio input through the first microphone and a second audio input through the second microphone.

Referring now to operation 903, the electronic device 101 may control a noise by comparing the first audio and second audio. According to an embodiment, the electronic device 101 may compare the audio difference of the first audio and second audio, check the frequency band corresponding to a voice and non-voice, and filter the audio of a frequency band corresponding to the non-voice (for example, a noise). The electronic device 101 may emphasize the audio of the voice region by filtering a frequency band corresponding to a particular range. In addition, although a frequency band corresponds to a voice, when the voice is checked as the voice input from farther than a specified distance, the electronic device 101 may filter the corresponding audio.

Referring now to operation 905, the electronic device 101 may output a noise-removed audio through the speaker and/or the communication interface. According to an embodiment, the electronic device 101 may output the noise-removed audio through the speaker included in the first element device 401 and/or the second element device 403. According to another embodiment, the electronic device 101 may encode the noise-removed audio through the encoder, and transmit the encoded audio data to the electronic device 102 connected through short-range wireless communication as the communication interface. The electronic device 101 may transmit, in the case of communicating with at least one other electronic device through the electronic device 102, the noise-removed audio data to the electronic device 102.

The electronic device 101 may end the embodiment of FIG. 9 after performing operation 905.

According to various embodiments of the disclosure, upon performing at least one operation included in FIG. 9, the electronic device 101 may check the battery status information included in the electronic device 101. According to an embodiment, the electronic device 101 may check the remaining amount information of the battery, and when the remaining amount of battery has a value higher than a predetermined value, the electronic device 101 may perform the operation 901 of FIG. 9.

According to an embodiment of the disclosure, upon performing at least one operation included in FIG. 9, the electronic device 101 may check the battery status information of a battery included in the electronic device 101. For example, when information on the battery consumption has a value higher than a predetermined value or when information on the remaining amount of the battery has a value lower than a predetermined value, the electronic device 101 may stop at least one operation being performed among operations included in FIG. 9 or end an embodiment of the FIG. 9.

According to an embodiment, the electronic device 101 may check the battery status information of the electronic device 101 during the operation (e.g., operation 901) of acquiring audio through the first microphone and the second microphone. When information on the remaining amount of the battery has a value lower than a predetermined value, or when information of the battery consumption has a value higher than a predetermined value, the electronic device 101 may stop the operation of the first microphone or the second microphone and acquire audio through one microphone. Here, upon acquiring the audio through one microphone, the electronic device 101 may end an embodiment of FIG. 9.

According to an embodiment, the electronic device 101 may check the battery status information of the electronic device 101 during the operation of controlling the noise (e.g., operation 903) or the operation of outputting the noise-removed audio (e.g., operation 905), and when information on the remaining amount of battery has a value lower than a predetermined value, or when information on the consumption of the battery has a value more than a predetermined value, the electronic device 101 may stop an embodiment of FIG. 9.

Figure 10:
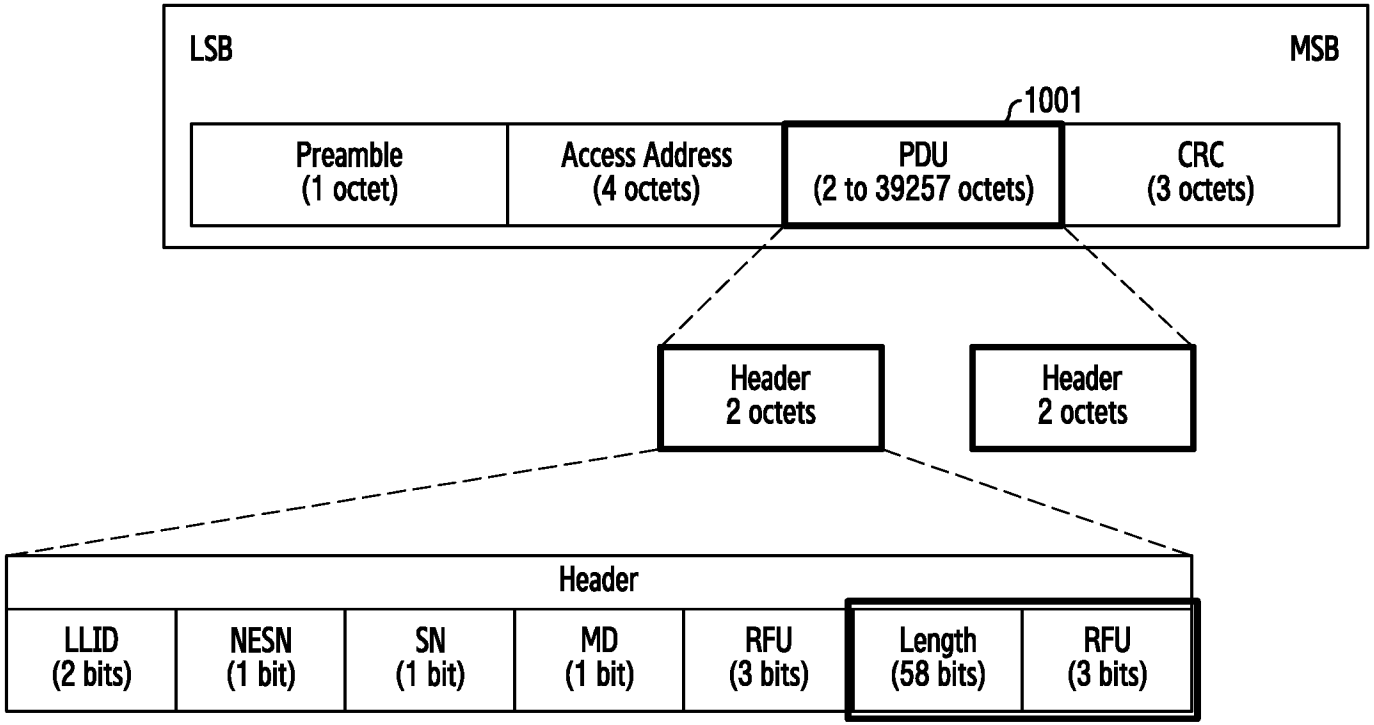
FIG. 10 is a diagram showing a data structure used for short-range wireless communication in an electronic device according to various embodiments of the disclosure.

FIG. 10 is a diagram showing a data structure used for short-range wireless communication in an electronic device according to various embodiments of the disclosure.

According to various embodiments of the disclosure, the electronic device 101 may be connected to, through the communication interface 160, another electronic device (for example, an electronic device 102) in at least one short-range wireless communication scheme. The short-range wireless communication scheme may be a communication scheme using at least one communication scheme among WiFi communication, Bluetooth (BT) communication, Bluetooth Low Energy (BLE) communication, Near Field Communication (NFC), Near Field Magnetic Induction (NFMI) communication, and Frequency Modulation (FM) communication. According to an embodiment, when transmitting and receiving audio data using BLE communication, the electronic device 101 may change (100) a part of the structure of the packet data, such as, low energy data packet length extension, and transmit and receive data to and from BLE communication packet of the extended size (e.g., 254 byte). The electronic device 101 may include high-quality audio data (e.g., audio data of 96 kbps) in the extended size BLE communication packet and transmit the data.

According to various embodiments of the disclosure, upon transmitting audio data using BLE communication, the electronic device 101 may transmit audio packet including the audio data by using the BLE communication. According to an embodiment, when transmitting the BLE communication packet (BLE packet) through the BLE communication, the electronic device 101 may transmit the packet including at least one audio packet between BLE packets. For example, when transmitting the BLE packet using BLE communication, the electronic device 101 may have an interval (e.g., a BLE sleep time) between BLE packet transmission and the next BLE packet transmission. Upon transmitting audio packet using BLE communication, the electronic device 101 may transmit at least one audio packet using the BLE sleep time.

Figure 11:
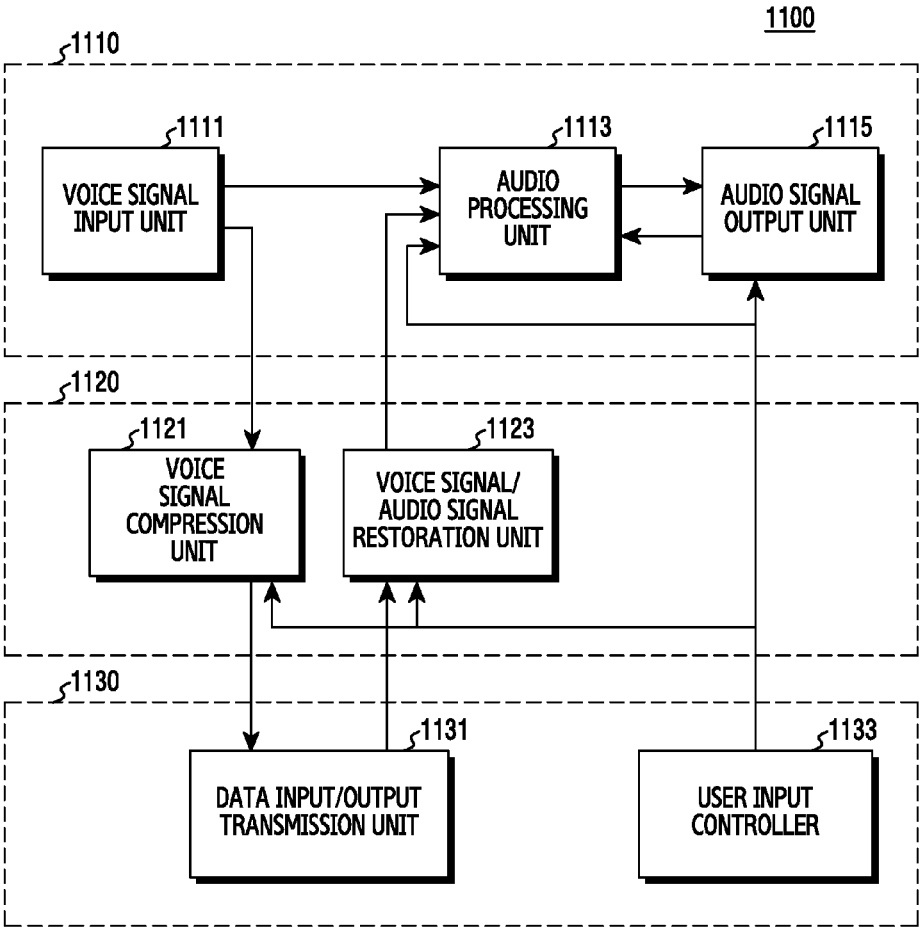
FIG. 11 shows a block diagram of an operation performed by an electronic device according to various embodiments of the disclosure.

FIG. 11 shows a block diagram of an operation performed by the electronic device according to various embodiments.

According to various embodiments of the disclosure, the electronic device 101 may be a device detachably fixed to or closely contacted with the user's ear to provide audio signal to the user. For example, the electronic device 101 may be configured as a hearing aid device which may amplify the audio signal generated from the outside and help the wearer to recognize the audio signal.

When configuring the electronic device 101 as a block diagram 1100, according to an embodiment, the block diagram 1100 may include at least one among a hearing aid unit 1110 for outputting audio after processing the input audio signal in consideration of a user profile, audio compression/decompression unit 1120 for restoring the audio or a voice signal input to the antenna or compresses the user voice signal input through the microphone to transmit the compressed signal to the antenna, and a communication and control unit 1130 for inputting/outputting data through the antenna and processing a system control signal.

Here, the hearing aid unit 1110 may include audio signal input unit 1111 (for example, the microphone 288 in FIG. 2) for detecting audio signal, audio processing unit 1113 for multiplying the input audio signal by an amplifying gain obtained in advance by considering the profile for the user's hearing characteristics, and audio signal output portion 1115 for reflecting an output gain such as a volume size on the result value of the audio processing to generate a signal that is reproduced to the user.

The audio compression/decompression unit 1120 may include a voice signal compression unit 1121 for compressing the user voice signal input to the microphone and configuring a data structure to be transmitted using an antenna, and a voice signal/audio signal restoration unit 1123 for restoring the signal by extracting audio part or a voice signal part from data signals input to the antenna.

The communication and control unit 1130 is configured by a data input/output transmitting unit 1131 for transmitting and receiving data between hearing aids and another electronic device (for example, the electronic device 102 or electronic device 103) and a controller 1133 for controlling an operating mode in response to user control inputs or controlling a system by monitoring power consumption of the system, etc.

Here, at least a part of the hearing aid unit 1110 and the audio compression/decompression unit 1120 may be configured to be included in the audio module 280 of FIG. 2.

When an input signal is input to the voice signal input unit 1121, the electronic device 101 may convert an analog signal to a digital signal, separate/divide the converted digital signal to a signal for each frequency band, and transmit the divided signal for each frequency band to the audio processing unit 1113. The audio processing unit 1113 may receive and process, in addition to the divided signal for each frequency band, user operation content that has been requested by the user through the user interface, data transferred through a communication interface, and a user profile stored in the storage unit. Upon processing the transferred signals, the audio processing unit 1113 may perform a process of amplifying the signal for each frequency band divided based on the user profile information. The audio processing unit 1113 may change the operating mode of the electronic device 101 by using the operation content requested through a user input control unit 1133, or read video or text information that has been stored so as to transmit data prepared to be output as a voice or a video to the audio signal output unit 1115. The audio signal output unit 1115 may include a filter unit for changing a digital voice signal output from the audio processing unit 1113 to an analog voice signal, and a receiver end for outputting the voice signal passed through the filter unit as a sound. Here, according to an embodiment, the user profile may include audiogram. The audiogram may be configured as a diagram showing a hearing threshold for a particular frequency band. The hearing threshold may mean the smallest sound that can be heard by a listener. A first axis of the audiogram (e.g., a vertical axis) may indicate the strength of the sound indicated in decibel, and a second axis (e.g., a horizontal axis) may indicate the acoustic frequency band. The audiogram can be data generated by the hearing test of the user.

The voice signal compression unit 1121 may transmit data after compressing the input voice data to another electronic device (e.g., the electronic device 102 or electronic device 103) using network communication connected to the data input/output transmission unit 1131. It is possible to process in a time domain that has less delay using a voice data compression scheme that is used in the voice signal compression unit 1121. According to an embodiment, a G.722 scheme can be used as the voice data compression scheme.

Upon transmitting and receiving audio data to and from another electronic device (for example, the electronic device 102 or electronic device 103), in order to provide an interactive service, the electronic device 101 may process the audio data by distinguishing a voice signal and audio signal. According to an embodiment, upon making a phone call with another electronic device, the electronic device 101 may perform the data compression process in a time domain for a real-time low delay processing to be enabled. According to an embodiment, the G.722 scheme can be used for real-time data compression. A signal to be reproduced in the electronic device 101 can be output after performing the customized modification to the user's profile.

The electronic device 101 may set the operation modes of the electronic device 101, such as audio reproduction/wearable communication/a normal mode, using the user input control unit 1133. The user input control unit 1133 may perform the operation in conjunction with at least one among a predetermined button located in the electronic device 101, or at least one among other electronic devices connected to the electronic device 101 using a network communication channel, a touch panel for any one among other electronic devices, or a microphone included in the electronic device 101. For example, in the normal mode, when a predetermined button located in the electronic device 101 or a remote controller for transmitting control information to the electronic device 101 is pressed, the electronic device 101 may set the operating mode of the electronic device 101 to audio reproduction mode, and, in the audio reproduction mode, when the predetermined button located in the electronic device 101 is pressed, the operation mode of the electronic device 101 can be set as the normal mode.

According to an embodiment of the disclosure, when the electronic device 101 and at least one other electronic device (for example, the electronic device 102) are connected to each other using a network communication channel, and, in the normal mode, when the wearer's touch input is detected from a touch panel included in the other electronic device (for example, the electronic device 102), the electronic device 101 may set the operation mode to the audio reproduction mode.

According to an embodiment of the disclosure, the electronic device 101 may preset audio signal for entering the audio reproduction mode. When the electronic device 101 detects the audio signal by using the microphone, the electronic device 101 may compare the detected audio signal with a predetermined audio signal. When the detected audio signal is similar to the predetermined audio signal, the electronic device 101 may set the operation mode to the audio reproduction mode, and if the detected audio signal is different from the predetermined audio signal, the electronic device 101 may set the operation mode to the normal mode or maintain as it is. When receiving a call while using the audio reproduction mode, the electronic device 101 may control the music level (a volume) using the user input control unit 1133, and after a pause and a call has ended, reproduce music again.

The user input control unit 1133 may control the consumption of the battery. When the electronic device 101 is a binaural hearing aid device and the difference between currents used by both batteries has a value greater than a predetermined value, the electronic device 101 may exchange the roles of the element devices using a connectivity function of the first element device and the second element device, and control the difference of the remaining amounts between the batteries has a value so as not to exceed a predetermined value.

When measuring a battery usage level and checking the remaining amounts of the battery power, the user input control unit 1133 may calculate the battery usage level using a function used in the electronic device 101, function-specific use time, power magnitude of an input signal, and the value of magnitude of an output signal, and the battery remaining amount may check the difference between the pre-used battery power amount and the standard battery power amount and may determine whether to use the battery of any device between the first element device or the second element device.

Figure 12:
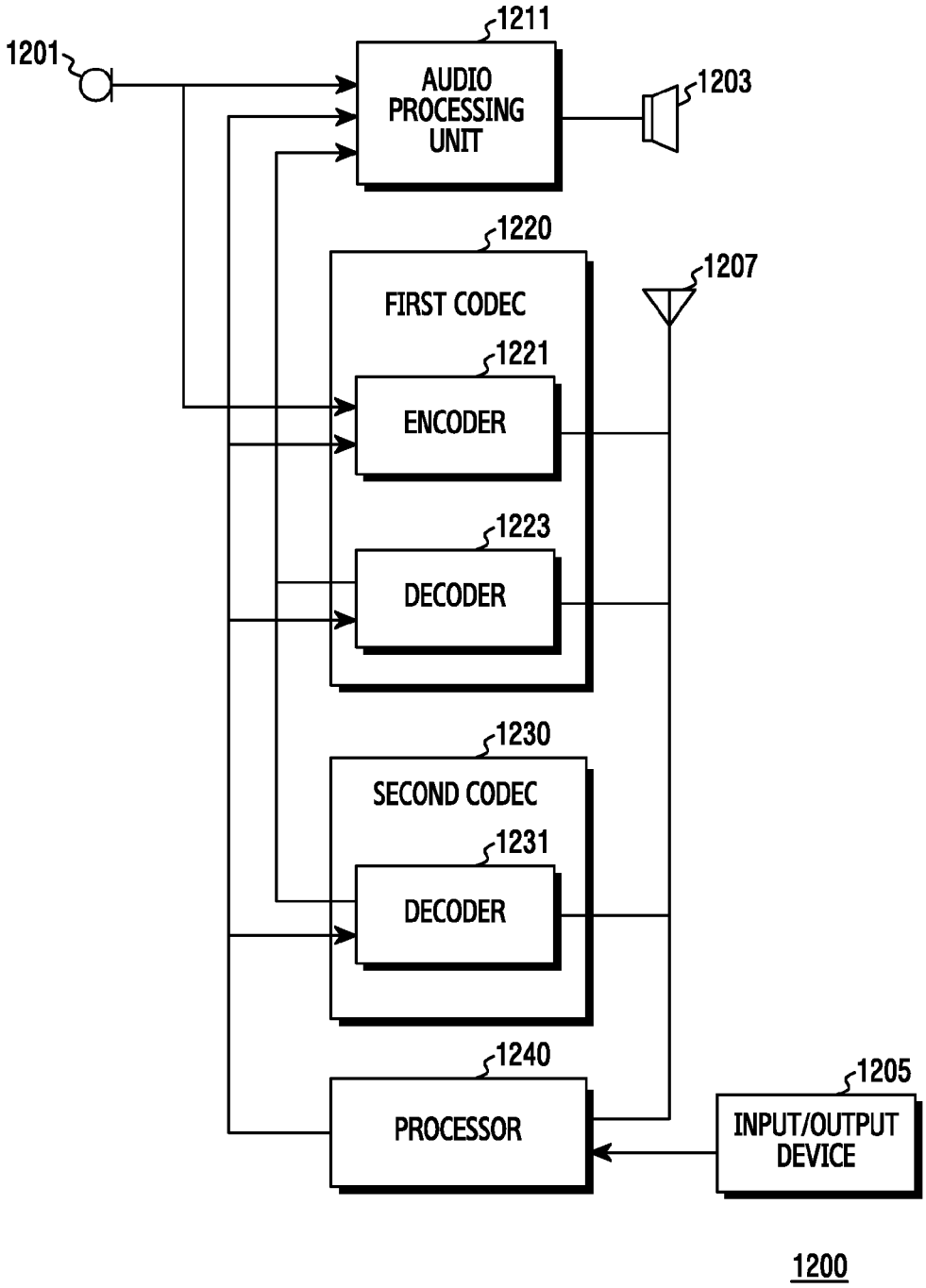
FIG. 12 shows a configuration of an operation of processing, by an electronic device, an input audio and a received audio according to various embodiments of the disclosure.

FIG. 12 shows a configuration of an operation for processing, by an electronic device, an input audio and a received audio according to various embodiments.

According to various embodiments, the electronic device 101 may include at least one codec and process audio (or audio signal or audio data) to be input or received to or from the electronic device 101. According to an embodiment, the electronic device 101 may include a first codec 1220 configured to process audio input through the microphone 1201, transmit the processed audio data to another electronic device (e.g., the electronic device 102 or the electronic device 103) via an antenna 1207, and process the audio received from another electronic device, and a second codec 1230 configured to process the audio input from the electronic device 101 and output to the speaker 1203. The electronic device 101 may convert audio input through the microphone 1201 into audio data to be transmitted to another electronic device through an encoder 1221 of the first codec 1220. The electronic device 101 may transmit, through the antenna 1207, the converted audio data to another electronic device connected through network communication.

Upon processing the input audio or received audio, the electronic device 101 may process based on the battery status information included in the electronic device 101. According to an embodiment of the disclosure, the battery status information may include at least one piece of information among information on the remaining amounts of battery, information on battery consumption, information on the difference between the battery remaining amounts when two or more batteries are provided, and information on battery lifetime. When processing the audio based on the information of the battery status information, the electronic device 101 may stop an operation of the first codec 1220 or an operation of the second codec 1230. On the other hand, the electronic device 101 may stop an operation of a decoder 1223 included in the first codec 1220 and process the audio using a decoder 1231 included in the second codec 1230.

According to various embodiments of the disclosure, the electronic device may include a communication and control unit configured by a hearing aid unit for processing an input audio signal in consideration of a user profile and then outputting a sound, a sound compression/decompression unit for reconstructing audio or a voice signal input to the antenna or compressing a user voice signal input to the microphone to transmit the compressed user voice signal to the antenna; and a user input control unit for inputting/outputting data to/from the antenna and processing a system control signal of the user.

According to an embodiment of the disclosure, the hearing aid unit may include audio signal input unit for detecting audio signal, a sound processing unit for multiplying the input audio signal by an amplifying gain that is obtained in advance considering the profile of hearing characteristics of a user, and reflecting an output gain such as the size of the volume, on the sound processed result value to generate a signal to be reproduced to the user. According to an embodiment, the sound compression/decompression unit may include a voice signal compression unit for configuring a data structure by compressing a user audio signal input to a microphone and transferring the compressed audio signal using an antenna, and a voice signal/audio signal restoration unit for extracting audio or a voice signal part from a data signal input to the antenna and recovering the signal. According to an embodiment, the communication and control unit may include a data input/output transmission unit for transmitting/receiving data between an electronic device and an external terminal device, and a controller for receiving a user control input and controlling an operation mode or controlling a system by monitoring the power consumption of the system, etc. According to an embodiment, the audio compression/decompression unit may include audio signal compression unit and a voice signal/audio signal restoration unit. According to an embodiment, the output of the voice signal/audio signal restoration unit can be modified and output by reflecting the user profile for use in electronic device. According to an embodiment, the voice signal compression unit may compress the voice data of a wearer and transmit to another electronic device connected to each other using communication means. According to an embodiment, the voice signal compression unit may process audio in a time domain. According to an embodiment, the electronic device may use isochronous data transmission scheme for data communication. According to an embodiment, an electronic device may measure the use degree of a battery and control audio processing depending on the battery remaining amount. According to an embodiment, the electronic device may measure the use degree of a battery and use a function which has been used, function-specific use time, power magnitude of the input signal, and power magnitude of an output signal. According to an embodiment, when measuring the remaining amounts of the battery, an electronic device may check the difference between a standard battery power amount and a battery power amount that has been used.

According to various embodiments of the disclosure, the processor 1240 may change the mode of the electronic device 101 based on a user input that is input to the input/output device 1205. According to an embodiment, the electronic device 101 may output, in a specified operation such as the vibration, a call request received from another electronic device (for example, electronic device 102), connected through network communication, during outputting music. The electronic device 101 may accept a call received from the electronic device 102 based on a user input entered through the input/output device 1205, and may perform a communication function with a counterpart connected to the electronic device 102 through the microphone 1201 and/or the speaker 1203 included in the electronic device 101.

According to various embodiments of the disclosure, a method for operating an electronic device may include: acquiring battery status information of two or more element devices; determining whether the battery status information satisfies a reference condition, and controlling a function of at least one device among the two or more element devices. According to an embodiment, the battery status information may include at least one piece of information among information on the remaining amount of the battery, information on the battery consumption, information on the difference between the battery remaining amounts when two or more batteries are provided, and information on battery lifetime. According to an embodiment, an operation of determining whether the battery status information satisfies a reference condition may include an operation of checking the battery remaining amount of at least one battery has a value lower than a predetermined value, or the difference between the remaining amounts of power of two or more batteries has a value higher than a predetermined value. According to an embodiment, the operation for controlling a function of at least one device of the two or more element devices may include an operation of performing a function, may allow the function, which is being performed by the first element device, to be performed by a second element device. According to an embodiment, the function being performed by the first element device may perform at least one among encoding audio input through at least one microphone, transmitting the data of the encoded audio to another electronic device, and reproducing and outputting the audio data received from the other electronic device. According to an embodiment, the transmitting of the data of the encoded audio to another electronic device may be transmission of using a communication protocol of short-range wireless communication connected to another electronic device. In addition, while the specification references to remaining amounts of battery power, other criteria such as remaining time or percentage of charge left, for example, could be the basis for criteria.

According to an embodiment of the disclosure, an operation of acquiring device status information may further include an operation of checking a specified user's voice based on a user's profile, and an operation of controlling at least one function may further include an operation of stopping the output of the audio being output through the element device. According to an embodiment, audio being output through an element device may be audio received from another electronic device connected through short-range wireless communication. According to an embodiment, audio being output through the element device may be audio stored in the memory of the electronic device.

Various embodiments performed by the electronic device 101 may be operations performed by a control of the processor 120. In addition, the electronic device 101 may include a module, separate from the processor 120, which is programmed to control the various embodiments of the present disclosure. The separate module programmed to control the various embodiments of the present disclosure may operate under a control of the processor 120.

According to various embodiments of the disclosure, the processor 120 may acquire the battery status information on two or more element devices, determine whether the battery status information satisfies a reference condition, and control a function of at least one device among the two or more element devices. According to an embodiment, the processor 120 may include, in the battery status information, at least one among information on the remaining amount of the battery power, information on battery consumption, information on the difference between the battery remaining amounts when two or more batteries are provided, and information on battery lifetime. According to an embodiment, the processor 120 may check that the remaining amount of the at least one battery has a value lower than a predetermined value or the difference between the remaining amounts of two or more batteries has a value higher than a predetermined value. According to an embodiment, the processor 120 may allow the function, which is being performed by the first element device, to be performed by a second element device. According to an embodiment, the processor 120 may perform at least one operation of encoding audio input through at least one microphone, transmitting data of the encoded audio to another electronic device, and reproducing and outputting the audio data received from the other electronic device. According to an embodiment, the processor 120 may transmit using a communication protocol of short-range wireless communication connected with another electronic device. According to an embodiment, the processor 120 may stop audio output, which is being output through an element device, when checking a specified user's voice based on a user profile. According to an embodiment, the processor 120 may output the audio being output through the element device and the audio received from another electronic device connected through short-range wireless communication. According to an embodiment, the audio being output through the element device may be audio stored in the memory of the electronic device.

Each of the above described elements of the electronic device according to various embodiments of the present disclosure may include one or more components, and the name of a corresponding element may vary according to the type of electronic device. The electronic device according to various embodiments of the present disclosure may include at least one of the above described elements and may exclude some of the elements or further include other additional elements. Further, some of the elements of the electronic device according to various embodiments of the present disclosure may be coupled to form a single entity while performing the same functions as those of the corresponding elements before the coupling.

The apparatuses and methods of the disclosure can be implemented in hardware, and in part as firmware or via the execution of software or computer code in conjunction with hardware that is stored on a non-transitory machine readable medium such as a CD ROM, a RAM, a floppy disk, a hard disk, or a magneto-optical disk, or computer code downloaded over a network originally stored on a remote recording medium or a non-transitory machine readable medium and stored on a local non-transitory recording medium for execution by hardware such as a processor, so that the methods described herein are loaded into hardware such as a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc., that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. In addition, an artisan understands and appreciates that a "processor", "microprocessor" "controller", or "control unit" constitute hardware in the claimed disclosure that contain circuitry that is configured for operation. Under the broadest reasonable interpretation, the appended claims constitute statutory subject matter in compliance with 35 U.S.C. § 101 and none of the elements are software per se. No claim element herein is to be construed under the provisions of 35 U.S.C. 112, sixth paragraph, unless the element is expressly recited using the phrase "means for".

The definition of the terms "unit" or "module" as referred to herein are to be understood as constituting hardware circuitry such as a CCD, CMOS, SoC, AISC, FPGA, at least one processor or microprocessor (e,g, a controller or control unit) configured for a certain desired functionality, or a communication module containing hardware such as transmitter, receiver or transceiver, or a non-transitory medium comprising machine executable code that is loaded into and executed by hardware for operation, in accordance with statutory subject matter under 35 U.S.C. § 101 and do not constitute software per se. For example, the image processor in the present disclosure, and any references to an input unit and/or an output unit both comprise hardware circuitry configured for operation.

According to various embodiments of the present disclosure, at least some of the devices or methods according to various embodiment of the present disclosure as defined by the appended claims and/or disclosed herein may be implemented in the form of hardware, software in conjunction with hardware, firmware, or any combination of at least two of hardware, software, and firmware. The "module" may be the smallest unit that performs one or more functions or a part thereof. The "module" may be mechanically or electronically implemented. For example, the "module" according to the present disclosure may include at least one of an Application-Specific Integrated Circuit (ASIC) chip, a Field-Programmable Gate Arrays (FPGA), and a programmable-logic device for performing operations which has been known or are to be developed hereinafter. If implemented in software that is executed by hardware, a computer-readable storage medium (or storage medium readable by a computer) storing at least one program (or programming module) may be provided. The software may, for example, be implemented by instructions stored in a computer-readable storage medium in the form of a programming module that is executed by hardware. The at least one program may include instructions that cause the electronic device to perform the methods according to various embodiments of the present disclosure as defined by the appended claims and/or disclosed herein. When the command is executed by one or more processors (for example, the processor 120), the one or more processors may execute a function corresponding to the command. The computer-readable storage medium may, for example, be the memory 230. At least a part of the programming module may, for example, be implemented (e.g., executed) by the processor 220. At least a part of the programming module may, for example, include a module, a program, a routine, a set of instructions, or a process for performing at least one function.

According to various embodiments, an electronic device may include a computer-readable recording medium in which program for executing operations is recorded, the operations comprising: acquiring battery status information of two or more element devices; determining whether the battery status information satisfies a reference condition; and controlling a function of at least one device among the two or more element devices.

The computer-readable storage medium may include magnetic media such as a hard disc, a floppy disc, and a magnetic tape; optical media such as a compact disc read only memory (CD-ROM) and a digital versatile disc (DVD); magneto-optical media such as a floptical disk; a hardware device specifically configured to store and execute program instructions (e.g., programming module), such as a read only memory (ROM), a random access memory (RAM), and a flash memory; an electrically erasable programmable read only memory (EEPROM); a magnetic disc storage device; any other type of optical storage device; and a magnetic cassette. Alternatively, any combination of some or all of the may form a memory in which the program is stored. Further, a plurality of such memories may be included in the electronic device. In addition, the program instructions may include high class language codes, which can be executed in a computer by using an interpreter, as well as machine codes made by a compiler.

In addition, the program may be stored in an attachable storage device capable of accessing the electronic device through a communication network such as the Internet, an intranet, a local area network (LAN), a wide LAN (WLAN), a storage area network (SAN), or any combination thereof. The storage devices may be connected to an electronic device through an external port. Further, a separate storage device on the communication network may access a portable electronic device. Any of the hardware devices as described above may be configured to work as one or more software modules in order to perform the operations according to various embodiments of the present disclosure, and vice versa.

Any of the modules or programming modules according to various embodiments of the present disclosure may include at least one of the above described elements, exclude some of the elements, or further include other additional elements. The operations performed by the modules, programming module, or other elements according to various embodiments of the present disclosure may be executed in a sequential, parallel, repetitive, or heuristic manner. Further, some operations may be executed according to another order or may be omitted, or other operations may be added.

The embodiments of the present disclosure disclosed herein and shown in the drawings are merely specific examples presented in order to easily describe technical details of the present disclosure and to help the understanding of the present disclosure, and are not intended to limit the scope of the present disclosure. Therefore, it should be construed that, in addition to the embodiments disclosed herein, all modifications and changes or modified and changed forms derived from the technical idea of the present disclosure fall within the scope of the present disclosure.

What is claimed is:

1. A method for operating an electronic device comprising a first hearing aid which is connected to a second hearing aid, the method comprising:

acquiring battery status information of the electronic device;

transmitting the battery status information and information indicating a first function being operated in the electronic device to an external electronic device;

receiving, from the external electronic device, a control signal comprising information associated with a second function which is determined based on the battery status information and information indicating the first function being operated in the electronic device; and in response to receiving the control signal, stopping the first function and receiving an audio signal through a microphone included in the first hearing aid based on control signal; and transmitting the audio signal to the external electronic device.

2. The method of claim 1, wherein the battery status information comprises at least one status selected from among information regarding a remaining amount of charge of a battery, information regarding an amount of consumption of the battery, information regarding a difference between the amounts of battery remaining when two or more batteries are provided, and information regarding a battery lifetime.

3. The method of claim 1, in response to receiving the control signal, controlling the second hearing aid to stop at least one operation associated to a microphone included in the second hearing aid; and controlling the second hearing aid to stop at least one operation associated to communication for the external electronic device.

4. The method of claim 1, further comprising:

in response to receiving the control signal, further performing at least one operation based on the control signal, wherein the at least one operation comprises at least one operation from among, encoding the audio signal received through the microphone, and storing the audio signal received through the microphone.

5. The method of claim 1, wherein transmitting the encoded audio data to the external electronic device corresponds to transmitting the data using a communication protocol of short-range wireless communication connected with the external electronic device.

6. The method of claim 1, further comprising receiving a first audio signal from the external electronic device; outputting the first audio signal; and in response to receiving the control signal, stopping the reception of the first audio signal and receiving the audio signal through the microphone, wherein the battery status information is transmitted while outputting the first audio signal.

7. An electronic device comprising:

a first hearing aid configured to connected to a second hearing aid;

a battery;

a communication interface; and a processor configured to:

acquire battery status information of the electronic device;

control the communication interface to transmit the battery status information and information indicating a first function being operated in the electronic device to an external electronic device;

control the communication interface to receive, from the external electronic device, a control signal comprising information associated with a second function which is determined based on the battery status information and information indicating the first function being operated in the electronic device; and in response to receiving the control signal, control the communication interface to stop the first function and receive an audio signal through a microphone included in the first hearing aid based on control signal, and control the communication interface to transmit the received audio signal to the external electronic device.

8. The device of claim 7, wherein the battery status information comprises at least one information from among information on remaining amounts of a charge of the battery, information on an amount of consumption of the battery, information on a difference between remaining amounts when two or more batteries are provided, and information on battery lifetimes.

9. The device of claim 7, wherein, in response to receiving the control signal, the processor is configured to control the second hearing aid to stop at least one operation associated to a microphone included in the second hearing aid, and control the second hearing aid to stop at least one operation associated to communication for the external electronic device.

10. The device of claim 7, wherein the processor is further configured to perform at least one operation from among encoding the audio signal received through the microphone, or storing the audio signal received through the microphone.

11. The device of claim 7, wherein the processor transmits data using a communication protocol of a short-range wireless communication connected with the external electronic device.

12. The device of claim 7, wherein, the processor is further configured to receive a first audio signal from the external electronic device, and output the first audio signal, and in response to receiving the control signal, stop the reception of the first audio signal and receiving the audio signal through the microphone, and wherein the battery status information is transmitted while outputting the first audio signal.

13. An electronic device comprising:

a first hearing aid configured to connected to a second hearing aid;

a battery;

a communication interface; and a processor configured to:

acquire battery status information of the electronic device;

control the communication interface to transmit the battery status information and information indicating a first function being operated in the electronic device to an external electronic device;

control the communication interface to receive, from the external electronic device, a control signal comprising information associated with a second function which is determined based on the battery status information and information indicating the first function operated in the electronic device; and in response to receiving the control signal, stop an operation of the first function, and perform the second function based on the control signal.

14. The device of claim 13, wherein the first function comprises at least one of a first reception function receiving a first audio signal from the external electronic device, and an output function outputting the received first audio signal through the first hearing aid;

wherein the second function is a function comprises at least one of a second reception function receiving an audio signal through a microphone included in the first hearing aid, and a transmission function transmitting the received audio signal to the external electronic device.

15. The device of claim 13, wherein the second function comprises a volume control function.

* * * * *